US012196520B2

(12) United States Patent
Oaks et al.

(10) Patent No.: US 12,196,520 B2
(45) Date of Patent: Jan. 14, 2025

(54) MAGAZINE SPRING AND MAGAZINE ASSEMBLY

(71) Applicant: Sig Sauer, Inc., Newington, NH (US)

(72) Inventors: Derek A. Oaks, Manchester, NH (US); Adrian Thomele, Stratham, NH (US); Sean P. Toner, Merrimack, NH (US); Jacqueline McNally, Rochester, NH (US)

(73) Assignee: SIG SAUER, INC., Newington, NH (US)

( * ) Notice: Subject to any disclaimer, the term of this patent is extended or adjusted under 35 U.S.C. 154(b) by 0 days.

(21) Appl. No.: 18/172,483

(22) Filed: Feb. 22, 2023

(65) Prior Publication Data

US 2023/0266084 A1 Aug. 24, 2023

Related U.S. Application Data

(60) Provisional application No. 63/312,443, filed on Feb. 22, 2022.

(51) Int. Cl.
*F41A 9/65* (2006.01)
*F41A 9/71* (2006.01)

(52) U.S. Cl.
CPC .. *F41A 9/65* (2013.01); *F41A 9/71* (2013.01)

(58) Field of Classification Search
None
See application file for complete search history.

(56) References Cited

U.S. PATENT DOCUMENTS 4,077,619 A * 3/1978 Borlinghaus ..... F16F 1/04 267/248
4,111,407 A * 9/1978 Stager ..... F16F 1/08 267/166.1
4,139,959 A * 2/1979 Howard ..... F41A 9/70 42/50
4,397,453 A * 8/1983 Seecamp ..... F41A 9/70 267/180
4,472,900 A * 9/1984 Howard ..... F41A 9/65 42/50
4,589,218 A * 5/1986 Teppa ..... F41A 9/69 42/50
4,862,618 A * 9/1989 Szabo ..... F41A 9/69 42/50
4,995,179 A * 2/1991 Switzer ..... F41A 9/66 42/50

(Continued)

*Primary Examiner* — Derrick R Morgan
(74) *Attorney, Agent, or Firm* — Finch & Maloney PLLC

(57) ABSTRACT

A spring for a firearm magazine includes a top attachment leg, a plurality of upper coils connected to the top attachment leg, a plurality of intermediate coils below the upper coils, and a bottom attachment leg below the plurality of intermediate coils. The upper coils are sized and shaped to nest within the intermediate coils when the spring is fully compressed, reducing the solid height of the spring. In some embodiments, at least two complete upper coils and/or at least two complete lower coils nest within intermediate coils. In one example, at least some coils have a rectangular coil shape. The spring can be configured for use in a handgun magazine or a rifle magazine, for example. A handgun magazine and a magazine components kit including the spring are also disclosed.

19 Claims, 17 Drawing Sheets

(56) References Cited

U.S. PATENT DOCUMENTS 5,386,657 A * 2/1995 Racheli ..... F41A 9/69 42/50
5,425,299 A * 6/1995 Teetzel ..... F41A 21/30 42/114
5,482,261 A * 1/1996 Ortega ..... F16F 3/06 267/168
5,495,687 A * 3/1996 Waiser ..... F41A 9/70 89/33.1
5,568,696 A * 10/1996 Mauch ..... F41A 9/71 42/49.02
7,621,063 B2 * 11/2009 Fitzpatrick ..... F41A 9/70 42/50
8,234,810 B2 * 8/2012 Lee, III ..... F41A 9/67 42/87
8,646,200 B2 * 2/2014 Rendulic ..... F41A 9/65 42/49.02
8,739,446 B2 * 6/2014 Sullivan ..... F41A 9/69 42/50
8,991,084 B2 * 3/2015 Williams ..... F41A 9/62 42/50
9,234,714 B2 * 1/2016 Castro ..... F41A 9/83
9,383,151 B2 * 7/2016 Ballard ..... F41A 9/65
9,383,152 B2 * 7/2016 Nakayama ..... F41A 9/70
10,190,835 B2 * 1/2019 Hsu ..... F41A 9/71
10,563,941 B2 * 2/2020 Chen ..... F41A 17/34
10,619,959 B1 * 4/2020 Loveday, IV ..... F41A 9/72
10,788,280 B2 * 9/2020 Russell ..... F41A 9/65
11,009,304 B2 * 5/2021 Cross ..... F41A 9/68
11,054,202 B1 * 7/2021 Underwood ..... F41A 9/70
11,079,192 B2 * 8/2021 Corso ..... F41A 9/65
11,112,193 B2 * 9/2021 O'Clair ..... F41A 9/65
11,168,954 B1 * 11/2021 Spykerman ..... F41A 9/71
11,408,697 B2 * 8/2022 Szczepkowski ..... F41A 9/71
11,592,021 B2 * 2/2023 Baur ..... F04C 14/226
11,644,257 B1 * 5/2023 Roe ..... F41A 9/71 42/6
11,725,894 B2 * 8/2023 Kellgren ..... F41A 9/65 42/49.01
11,913,748 B2 * 2/2024 Rainaud ..... F41A 9/70
2008/0028661 A1 * 2/2008 Bubits ..... F41A 9/71 42/49.01
2010/0269389 A1 * 10/2010 Lopez Laparra ..... F41A 9/69 42/49.01
2012/0066950 A1 * 3/2012 Davidson ..... F41A 9/69 42/50
2012/0131831 A1 * 5/2012 Sullivan ..... F41A 9/65 42/50
2012/0167429 A1 * 7/2012 Sullivan ..... F41A 9/69 42/50
2013/0227870 A1 * 9/2013 Rendulic ..... F41A 9/65 29/426.6
2014/0020275 A1 * 1/2014 Corso ..... F41A 9/70 42/49.01
2022/0155033 A1 * 5/2022 Dugger ..... F41A 9/65
2023/0243610 A1 * 8/2023 Thomele ..... F41A 9/65 42/50

* cited by examiner

MAGAZINE SPRING AND MAGAZINE ASSEMBLY

TECHNICAL FIELD

The present disclosure relates generally to components for firearms magazines, and more particularly to a spring for a firearms magazine and a magazine including the spring.

BACKGROUND

Firearms design involves many non-trivial challenges. Traditionally, semiautomatic handguns have been made with a metal frame having a grip portion that defines a magazine well configured to retain a magazine. Autoloading rifles similarly have a receiver that defines a magazine well configured to receive a magazine. Whether for use in a handgun or a long gun, an ammunition magazine can retain cartridges in a single vertical stack, in an offset double stack, or a combination of single and double stacks. A magazine includes a magazine tube generally of rectangular cross-sectional shape that extends from a bottom end to an open upper end that defines feed lips. The bottom end of the tube can be closed by a removable baseplate. A magazine spring is retained in the magazine tube in a compressed state between the baseplate and a follower, where the spring biases the follower, and any ammunition in the magazine, towards the feed lips at the upper end of the magazine tube. When installed in the magazine well, the top-most round is positioned to be stripped from the magazine and loaded into the chamber during the reloading cycle.

SUMMARY

The present disclosure is directed to a spring for an ammunition magazine, a components kit including the spring, and a magazine assembly including the spring. In one example embodiment, the spring is configured for a handgun magazine and includes upper coils of a smaller size that can nest within larger coils of a rectangular coil shape. In another example, the components kit includes a spring, a spring plate, and a magazine base plate, and is configured to replace components of an existing magazine for the purpose of increasing the magazine capacity or simply replacing parts. A magazine spring is discussed with reference to a handgun magazine, but the present disclosure is not so limited, and the concepts disclosed herein apply to magazine springs for rifles and other long guns. Numerous variations and embodiments will be apparent in light of the present disclosure.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

Figure 1A:
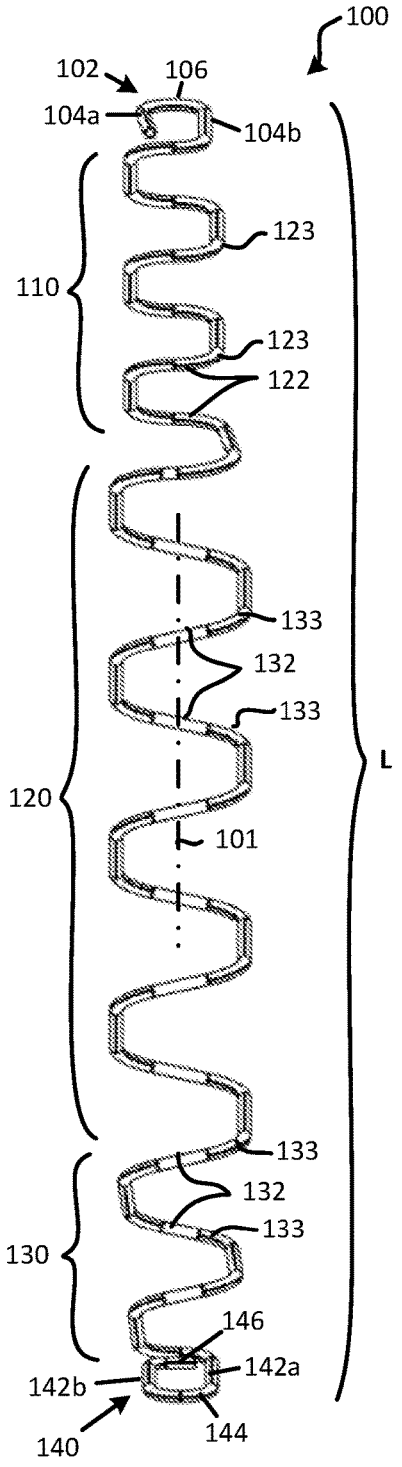
FIG. 1A illustrates a front view of a spring for a handgun magazine, in accordance with an embodiment of the present disclosure.

The Figures depict various embodiments of the present disclosure for purposes of illustration only. For purposes of clarity, not every component may be labeled in every drawing. Furthermore, as will be appreciated, the figures are not necessarily drawn to scale or intended to limit the present disclosure to the specific configurations shown. Numerous variations, configurations, and other embodiments will be apparent from the following detailed discussion.

DETAILED DESCRIPTION

Disclosed is a spring for an ammunition magazine, a components kit including the spring, and a magazine assembly including the spring. In accordance with one embodiment, a spring for a handgun magazine includes a top attachment leg, upper coils below the top attachment leg, intermediate coils below the upper coils, and a bottom attachment leg below the intermediate coils, where the upper coils are sized and shaped to nest within the plurality of intermediate coils when the spring is fully compressed. In some such embodiments, the spring includes one or more lower coils between the bottom attachment leg and the intermediate coils. In some embodiments, at least two upper coils and/or at least two lower coils can nest within the intermediate coils. The spring can have coils of oval or square shape, or a combination of oval and square coils, in accordance with some embodiments.

In some embodiments, the magazine spring has unique rectangular coils in addition to nesting features that reduce the solid height of the spring. Rectangular coil shapes tend to stack more neatly and tend to nest easier since the rectangular coil has a greater area than an oval coil of the same length and width. Also, rectangular spring coils can be designed to increase the effective length of each coil, resulting in increased deflection and pitch. Such rectangular coil design also can reduce the peak stresses along the spring by distributing the stress along a greater coil length. Attachment coils at the top and bottom of the spring can nest into the adjacent working coils when the spring is compressed so that the attachment legs do not add to the solid height of the spring. Also, the smaller upper coils can nest within the larger intermediate coils, and smaller lower coils (when present) can nest at least partially within the intermediate coils when the spring is compressed. For example, front portions of the lower coils nest within the intermediate coils, but rear portions of the lower coils need not nest in all embodiments since the floorplate may not be oriented perpendicularly with the magazine tube axis and therefore allows additional space for non-nesting rear portions of the spring. Some or all of these features can be combined to result in a spring having a reduced coil count, an increased coil pitch, and/or improved efficiency. In some embodiments, the solid height of the magazine spring provides a stop between the follower and the floorplate.

In addition to nesting features of the spring, a magazine assembly can include one or both of a spring plate that is recessed into the magazine base plate and a follower that is shaped to reduce vertical height of the assembly. The follower can be constructed to overlap the spring when the spring is compressed, reducing vertical height of the spring and follower.

Advantageously, a magazine spring and magazine assembly of the present disclosure can include combinations of features to increase magazine capacity by 1-2 rounds for a handgun magazine of a given tube length. For example, the capacity of a magazine originally configured to hold 15 rounds can be increased to hold 16 or 17 rounds by retrofitting with a magazine components kit. Examples of handgun magazines that can benefit from components disclosed herein include the 9 mm P320 and P365 magazines made by Sig Sauer Inc. Magazines for rifle ammunition can also benefit from the concepts disclosed herein. Numerous variations and embodiments will be apparent in light of the present disclosure.

Overview

Depending on the intended use, ammunition capacity can be an important factor when selecting a handgun. Semiautomatic handguns use a removable box magazine that is received in the magazine well defined in the gun's handgrip. Handgun magazines traditionally have been available in two main configurations, namely, single stack and double stack. In single-stack magazines, all cartridges are aligned in a single column with each cartridge arranged on top of the cartridge below it. Single-stack box magazines enable the grip of the handgun to have a lateral thickness of about one inch (~2.5 cm), sometimes slightly less, depending on chambering and the particular grips installed on the frame. A single-stack magazine is often found in handguns with a smaller thickness. Another approach to increasing magazine capacity is to structure the magazine tube to hold two offset columns of cartridges, referred to as a "double stack" magazine. Many full-size handguns include a double stack magazine and can have a capacity of 10, 12, 15, or 17 rounds, for example. The capacity can be increased slightly by adding some length to the magazine baseplate, also referred to as an extended baseplate. However, increasing the grip's lateral thickness or adding length to the grip are approaches that increase the overall size and mass of the handgun. This increased size makes it more difficult to effectively conceal the handgun.

It would be desirable to increase magazine capacity without adding to the overall size of a magazine. The present disclosure addresses this need and others by providing a magazine spring with a reduced solid height. Increased magazine capacity can further be realized with features of other magazine components that save space in the magazine tube. In accordance with some embodiments, features of the spring and other magazine components reduce the vertical size of those components and increase the ammunition capacity compared to existing magazines using the same magazine tube. Numerous configurations and variations will be apparent in light of this disclosure.

As will be appreciated in light of the present disclosure, and in accordance with some embodiments, ammunition magazines configured as described herein are not limited to semiautomatic handguns and can be utilized with any of a wide range of firearms. In accordance with some example embodiments, a magazine configured as described herein can be utilized with a semiautomatic handgun chambered in .380 Auto, 9 mm Luger, .357 SIG, 10 mm Auto, .40 S&W, .45 ACP ammunition, or other suitable ammunition. Other suitable host firearms and ammunition will be apparent in light of this disclosure.

As discussed herein, terms referencing direction, such as upward, downward, vertical, horizontal, left, right, front, back, etc., are used for convenience to describe embodiments of a magazine in an upright orientation. Embodiments according to the present disclosure are not limited by these directional references and it is contemplated that magazines of the present disclosure could be used in any orientation. Also note that the spring plate and base plate as disclosed herein can alternately be referred to as an inner base plate and outer base plate, respectively.

EXAMPLE EMBODIMENTS

Figure 1B:
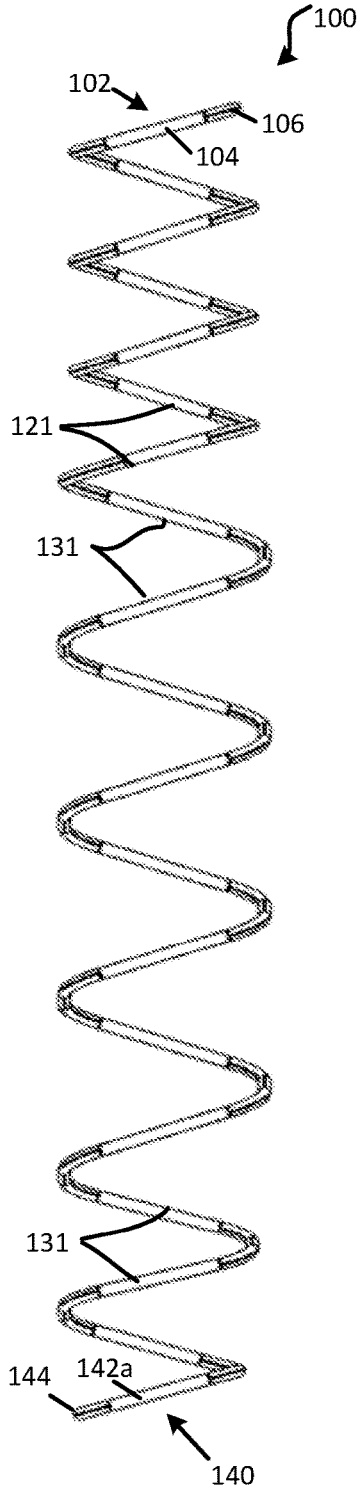
FIG. 1B illustrates a side view of the spring of FIG. 1A.
Figure 1C:
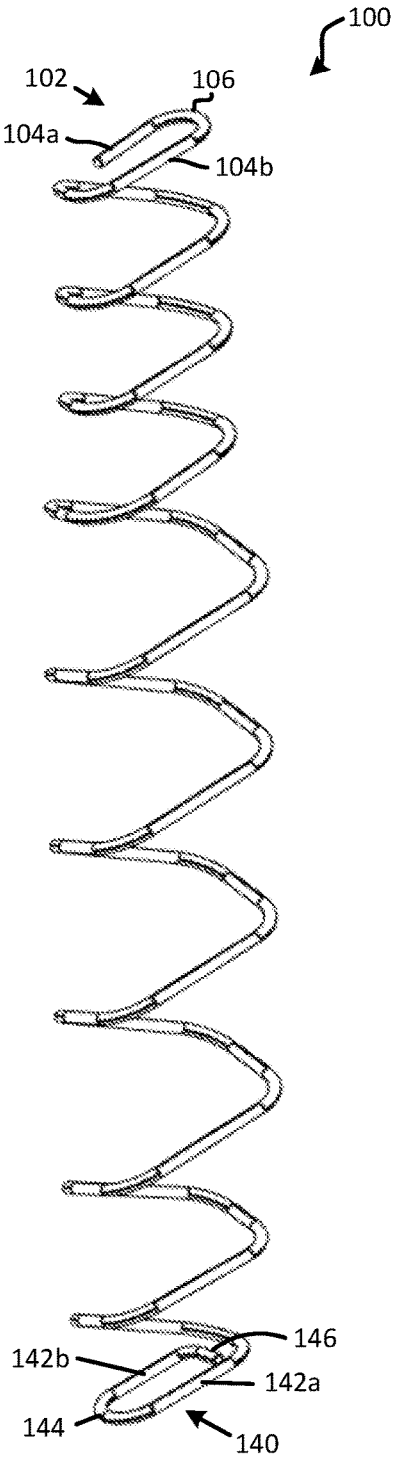
FIG. 1C illustrates a perspective view of the spring of FIG. 1A.
Figure 1D:
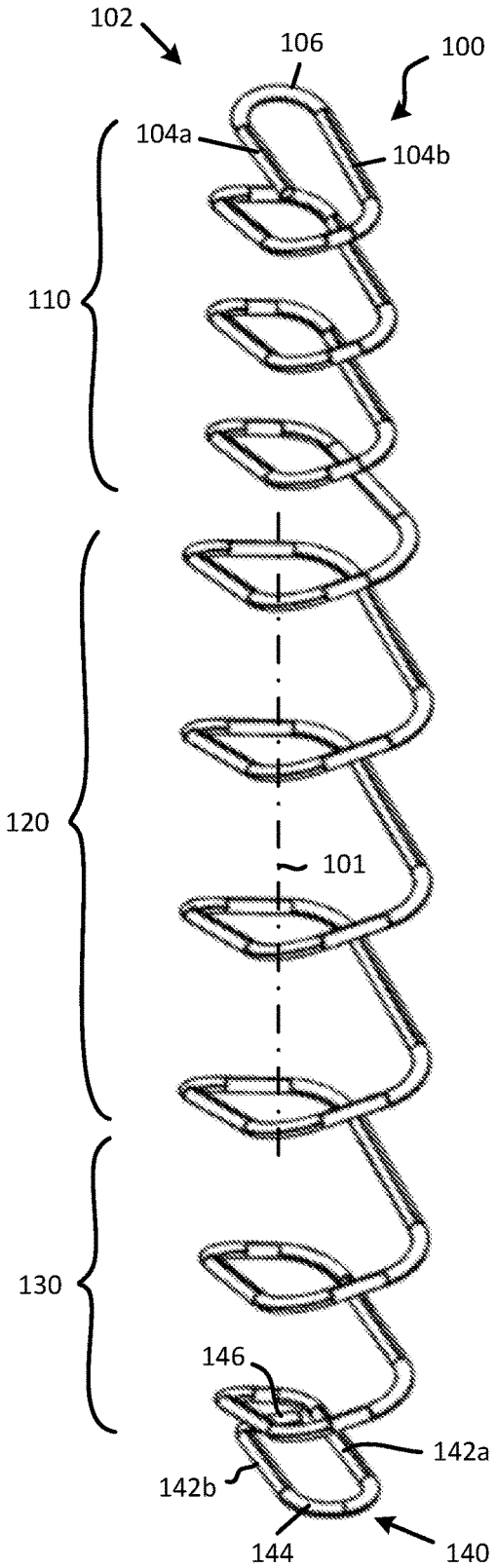
FIG. 1D illustrates another perspective view of the spring of FIG. 1A.
Figure 1E:
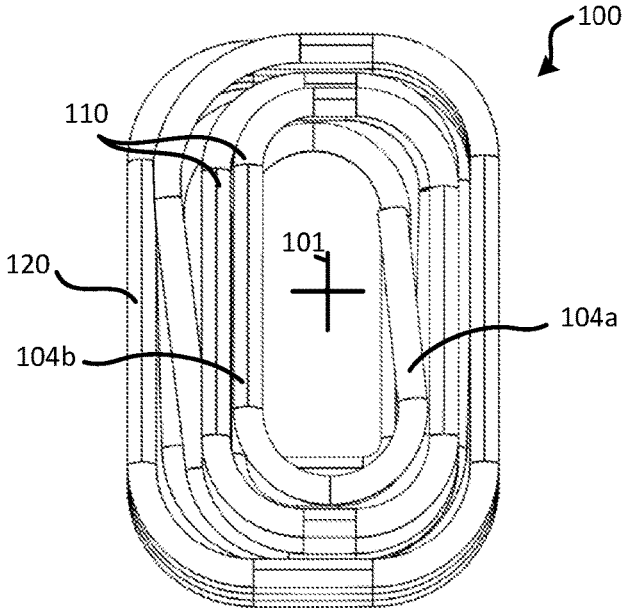
FIG. 1E illustrates a top plan view of the spring of FIG. 1A.
Figure 1F:
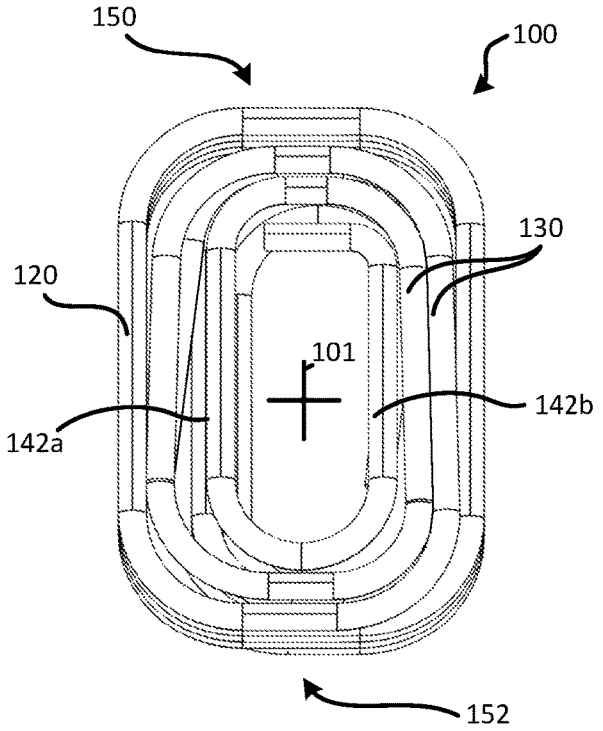
FIG. 1F illustrates a bottom plan view of the spring of FIG. 1A.
Figure 1G:
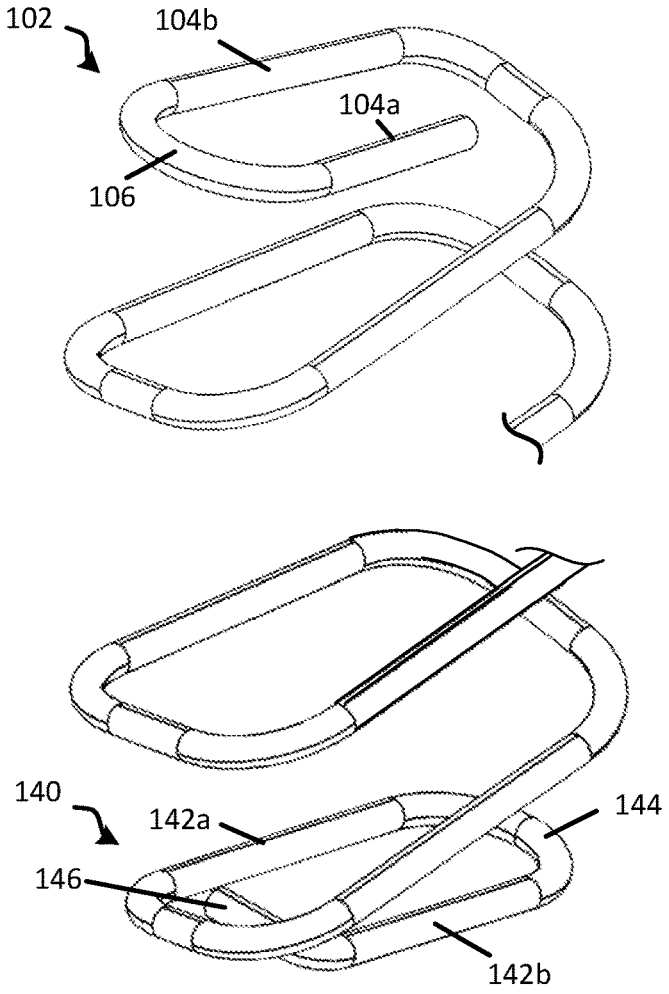
FIG. 1G illustrates top and bottom end portions of a spring for a handgun magazine, in accordance with some embodiments of the present disclosure.

FIGS. 1A-1G illustrate various views of a magazine spring 100 in a relaxed state, in accordance with an embodiment of the present disclosure. FIG. 1A is a front view, FIG. 1B is a side view, FIGS. 1C and 1D are perspective views, FIG. 1E is a top view, FIG. 1F is a bottom view, and FIG. 1G illustrates perspective views of individual spring portions. In its relaxed state, the spring 100 has a free length L that can be measured along a central spring axis 101 from a bottom end portion 140 to a top end portion 102.

Spring 100 includes a top end portion 102 that includes straight segments 104*a*, 104*b* and turn 106. Straight segment 104*b* is part of one of the upper spring coils 110 of a first size. Intermediate spring coils 120 of a second, larger size are below the upper spring coils 110 and connect to lower spring coils 130. The lower spring coils 130 connect to straight segments 142*a*, 142*b*. Straight segment 142*a* is part of the lowermost lower spring coil 130 in some embodiments. Straight segment 142*b* can be an attachment leg that engages the magazine's spring plate.

Some or all of the upper spring coils 110 can nest within the intermediate spring coils 120 when the spring 100 is compressed. In some embodiments, at least two complete coils of the upper spring coils 110 nest (or can nest) within the intermediate spring coils 120. In some embodiments, at least three complete upper spring coils 110 can nest within the intermediate coils 120. Similarly, some or all of the lower spring coils 130 can nest within the intermediate spring coils 120 when the spring 100 is compressed. In some embodiments, at least two complete coils of the lower spring coils 130 nest (or can nest) within intermediate coils 120. In some embodiments, at least three coils of the lower spring coils 130 can nest within intermediate coils 120. For example, in a fully compressed state, portions of the lower spring coils 130 are nested within the intermediate coils 120 below the upper spring coils 110, which are nested within the intermediate coils, such as shown in FIGS. 2A-2E and discussed below in more detail. In this example, the spring 100 includes three and a half complete upper coils 110 (including straight segment 104*b*), four complete intermediate coils 120, and two complete lower coils 130 (including straight segment 142*a*) for a total of 9.5 working coils. In other embodiments, the spring 100 has from 9-11 coils. Other numbers of coils can be used depending on the particular magazine tube length and other considerations, as will be appreciated.

In the example shown, part of top end portion 102 (e.g., straight segment 104*b* and part of turn 106) and part of bottom end portion 140 (e.g., straight segment 142*a* and part of turn 144) are part of working coils. Straight segments 104*a*, 104*b* are connected by a turn 106 of about 180°, where the straight segments 104*a*, 104*b* are oriented generally parallel to one another (e.g., ±10° from true parallel). The bottom end portion 140 includes straight segments 142*a*, 142*b* connected by a turn 144 of about 180°. Straight segment 142*b* connects to a terminal transverse leg 146 that extends towards straight segment 142*a*. Straight segment 142*b* is generally parallel to straight segment 142*a* (e.g., ±10° from true parallel) in this example.

In accordance with one embodiment, upper coils 110, intermediate coils 120, and lower coils 130 have a rectangular coil shape that includes straight side segments and straight end segments connected by curved corners. For example, upper coils 110 include straight side segments 111 and straight end segments 112 connected by curved segments 113. In some embodiments, the straight side segments 111 of upper coils 110 have a length from 10-15 mm, such as about 14 mm; straight end segments 112 of upper coils 110 have a length from 1-5 mm, such as about 3 mm. Similarly, intermediate coils 120 include straight side segments 121 and straight end segments 122 connected by curved segments 123. In some embodiments, straight side segments 131 of the intermediate coils 120 have a length from 12-17 mm, such as about 15.5 mm; straight end segments 132 of the intermediate coils 120 have a length from 4-8 mm, such as about 6 mm. Also, lower coils 130 include straight side segments 131 and straight end segments 132 connected by curved segments 133. In some embodiments, straight side segments 131 of lower coils 130 have a length from 11-15 mm, such as about 14 mm; straight end segments 132 of lower coils 130 have a length from 2-5 mm, such as about 4 mm. In accordance with some embodiments, a straight spring coil segment is defined as having a linear path of at least 1 mm, include at least 1.5 mm, at least 2 mm, or at least 3 mm. Curved segments 113, 123, 133 span an arc of about 90°±5°.

In other embodiments, some or all of the spring coils have an oval shape, an elliptical shape, or a "racetrack" shape (e.g., straight sides with semicircular ends). In some such embodiments, intermediate coils 120 have a rectangular coil shape and upper coils 110 have an oval shape that is sized to nest within the intermediate coils 120. In some embodiments, the lower coils 130 can also have an oval shape that nests partially or completely within the intermediate coils 120. For example, a front portion of each lower coil 130 can nest within intermediate coils 120 while a rear portion of lower coils 130 stacks with intermediate coils 120. In yet other embodiments, all of the upper coils 110, intermediate coils 120, and lower coils 130 have an oval shape.

In the top view of FIG. 1E, straight segment 104*a* can be nested within upper spring coils 110, the entirety of which are also nested within intermediate coils 120. Note that straight segment 104*a* need not nest in all embodiments and may protrude above the coil stack during use with a magazine. In the bottom view of FIG. 1F, straight segment 142*b* can be nested within lower spring coils 130, which are partially nested within the intermediate coils 120. Note that straight segment 142*b* need not nest and may protrude below the coil stack in use, in some embodiments. In this example, the lower coils 130 nest at the front 150 of the spring 100, but some or all of the lower coils 130 stack with the intermediate coils 120 at the rear 152 of the spring 100. In other embodiments, the entirety of each lower coil 130 nests within the intermediate coils 120.

FIG. 1G illustrates a close-up, perspective view of top end portion 102 and bottom end portion 104 of spring 100, in accordance with one embodiment. As discussed above, the top end portion 102 includes straight segments 104*a*, 104*b* connected by turn 106 spanning about 180°. Bottom end portion 104 has straight segments 142*a*, 142*b* connected by a turn 144 spanning about 180° between ends of the straight segments 142*a*, 142*b*.

Figure 1H:
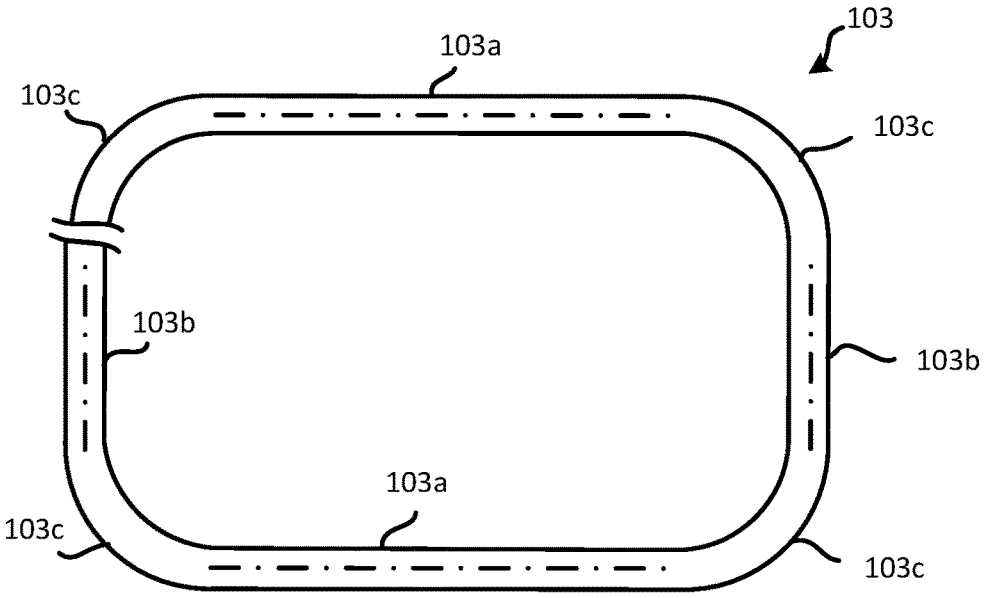
FIG. 1H illustrates an example of a rectangular spring coil, in accordance with an embodiment of the present disclosure.

FIG. 1H illustrates a top view of a spring coil 103 having a rectangular coil shape, in accordance with an embodiment of the present disclosure. In this example, representative of an intermediate spring coil 120, the spring coil 103 has straight side segments 103*a* and straight end segments 103*b* connected by curved segments 103*c* of about 90°. Each straight segment has a length of at least 1 mm. In some embodiments, the straight side segments have a length from 9-20 mm and the straight end segments have a length from 2-8 mm as appropriate for the geometry of the magazine tube and considering the desired coil pitch, wire diameter, and other physical and functional characteristics of the spring. Segments of the spring coil 103 follow a generally helical path to connect successive coils that define a magazine spring 100.

Figure 2A:
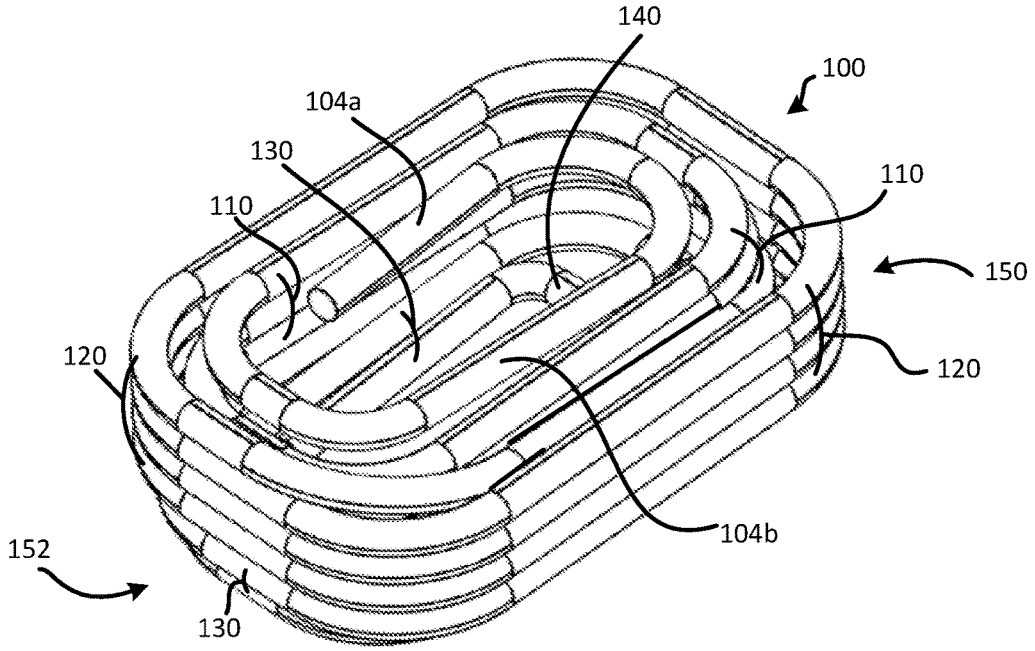
FIG. 2A illustrates a perspective view of a spring in a compressed condition, in accordance with an embodiment of the present disclosure.
Figure 2B:
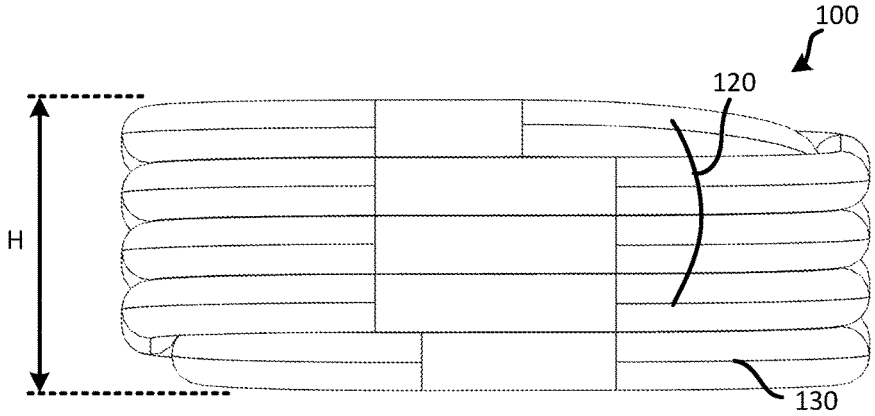
FIG. 2B illustrates a rear-end view of the spring of FIG. 2A.
Figure 2C:
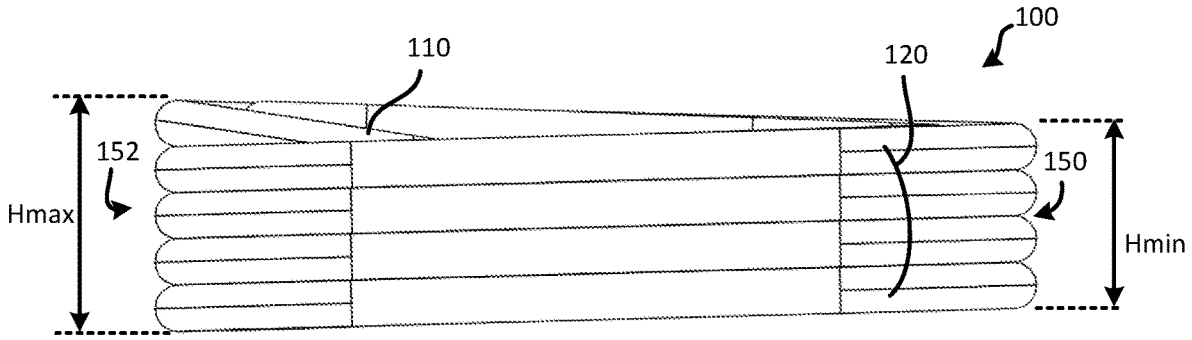
FIG. 2C illustrates a side view of the spring of FIG. 2A.
Figure 2D:
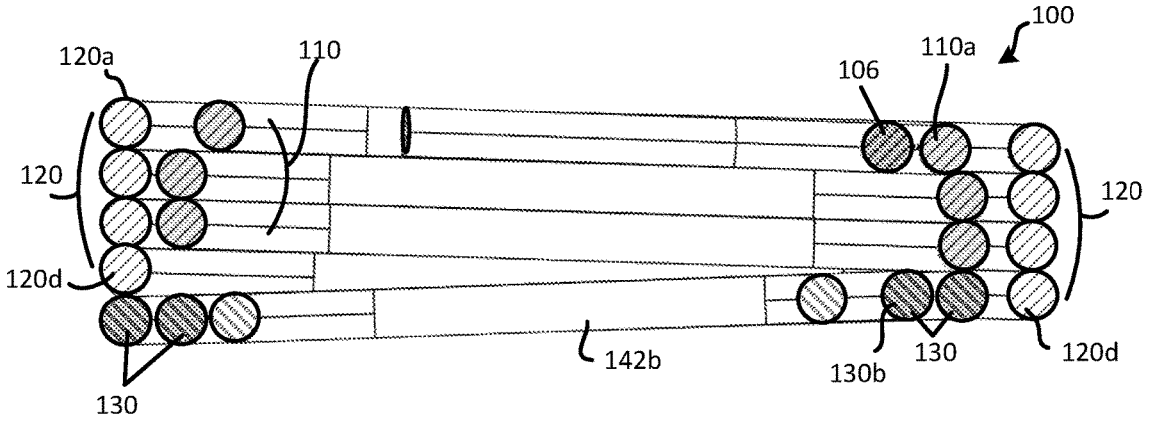
FIG. 2D illustrates a cross-sectional side view of the spring of FIG. 2A.
Figure 2E:
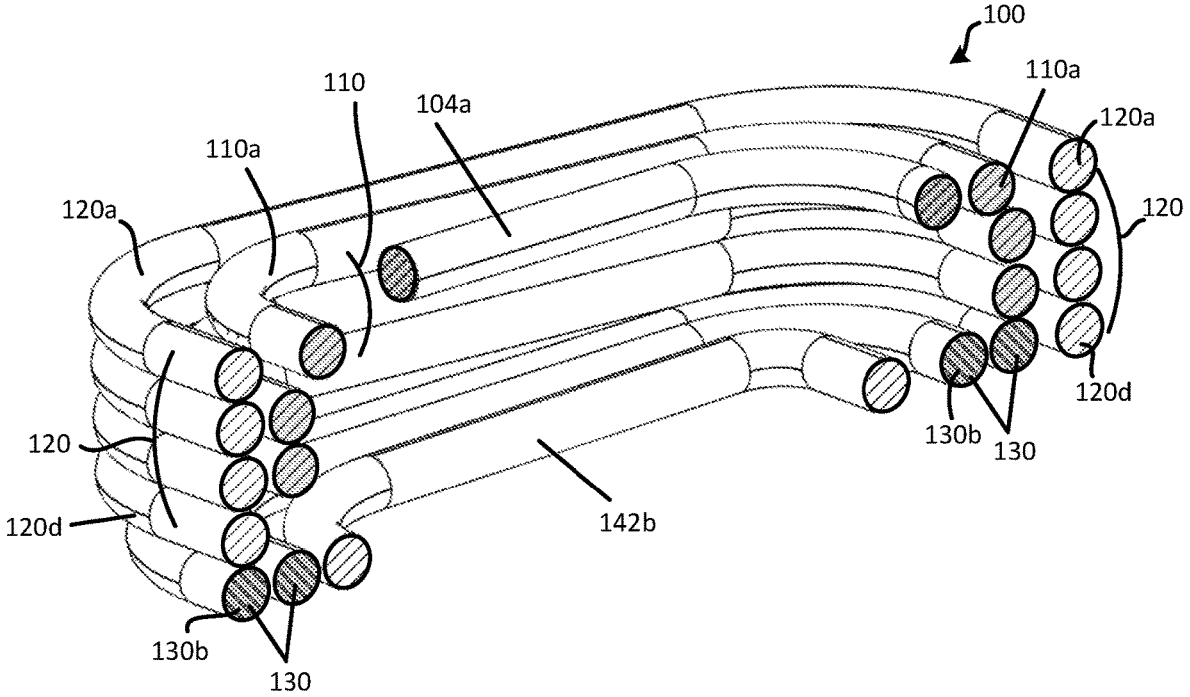
FIG. 2E illustrates a cross-sectional perspective view of the spring of FIG. 2A.

Referring now to FIGS. 2A-2E, various views illustrate a magazine spring 100 in a compressed condition, in accordance with an embodiment of the present disclosure. FIG. 2A illustrates a top, rear, and side perspective view; FIG. 2B illustrates a rear elevational view; FIG. 2C illustrates a side elevational view; FIG. 2D illustrates a cross-sectional side view; and FIG. 2E illustrates a top, rear and side cross-sectional view.

In its fully compressed state, the spring 100 has a solid height H that is less than the product of the number of coils and the wire diameter. That is, the different sizes of spring coils along the height of the spring 100 allow for nesting of upper coils 110 and/or lower coils 130 within intermediate coils 120. Note in this example that the solid height H at the front 150 of the spring 100 is less than the solid height H at the rear 152 of the spring 100. This difference is due to the size and shape of the lower coils 130, which allows some or all of the front 150 of lower coils 130 to nest within the intermediate coils 120 and at least some of the rear 152 of lower coils 130 to stack with intermediate coils 120. Accordingly, in the compressed state, the rear 152 of spring 100 has a greater number of stacked coils and greater solid height H compared to the front 150 of the spring 100, in some embodiments. In other embodiments, the lower coils 130 nest completely within the intermediate coils in both the front 150 and rear 152 of the spring 100. In some embodiments, the maximum solid height $H_{max}$ is less than 60% of the product of number of coils and wire diameter. In one example, such as the spring 100 shown in FIGS. 1A-1C having 10.5 total coils, including 9.5 working coils, the maximum solid height $H_{max}$ is 6 wire diameters at the rear 152 of the spring 100 and the minimum solid height $H_{min}$ is 4 wire diameters at the front 150 of spring 100.

In the perspective view of FIG. 2A, straight segment 104*a* and upper coils 110 are nested within the intermediate coils 120; the straight segment 142*b* can also be seen nested within lower coils 130, the front part of which are nested within the intermediate coils 120. In the rear view of FIG. 2B, the lower coils 130 stack with intermediate coils 120. In the side view of FIG. 2C, the maximum solid height $H_{max}$ at the rear 152 of the spring is dictated by the stack of lower coils 130 and intermediate coils 120; the minimum solid height $H_{min}$ at the front 150 of the spring is the height of the stacked intermediate coils 120, which is four wire diameters in this example. Since the base plate 180 may not be oriented perpendicularly to the axis of the magazine tube, the spring 100 may not compress at the rear of the magazine to the same extent as it does at the front of the magazine. Thus, it is more desirable to reduce the solid height H at the front 150 of the spring 100 than at the rear 152 since the angled orientation of the magazine tube and base plate allows for a somewhat greater solid height H at the rear 152 of the spring 100. Thus, in some embodiments, the spring 100 can benefit from the forces associated with an increased size of lower coils 130 that do not nest completely with intermediate coils 120, compared to smaller lower coils 130 that can nest completely within the intermediate coils 120. Accordingly, lower coils 130 nest partially within intermediate coils 120 in some embodiments.

FIGS. 2D and 2E illustrate sectional side and perspective views, respectively, of spring 100 in a compressed state. In these figures, ends of coils are shaded for ease of identifying the coils: straight segment 104*a* has a dark shading, upper coils 110 have a medium shading, intermediate coils 120 have white shading, and lower coils 130 have a dark shading. Straight segment 104*a* is shown as being nested within and aligned with the uppermost upper spring coil 110, which is nested within the top intermediate coil 120*a*. The straight segment 142*b* is shown as being nested within and aligned with the bottom-most lower coil 130, which is partially nested within the bottom intermediate coil 120*d*. At the front 150 of the spring 100, lower coils 130 nest within one another and within bottom intermediate coil 120*d*. At the rear 152 of the spring 100, lower coils 130 stack with intermediate coils 120. Note that straight segment 104*a* may not nest completely and/or may not align with the top upper coil 110*a* in all cases, depending on the attachment with the follower. Similarly, straight segment 142*b* at the bottom end portion 104 may not nest completely and/or may not align with the bottom lower coil 130*b* in all cases, depending on the attachment with the spring plate 160.

Figure 3A:
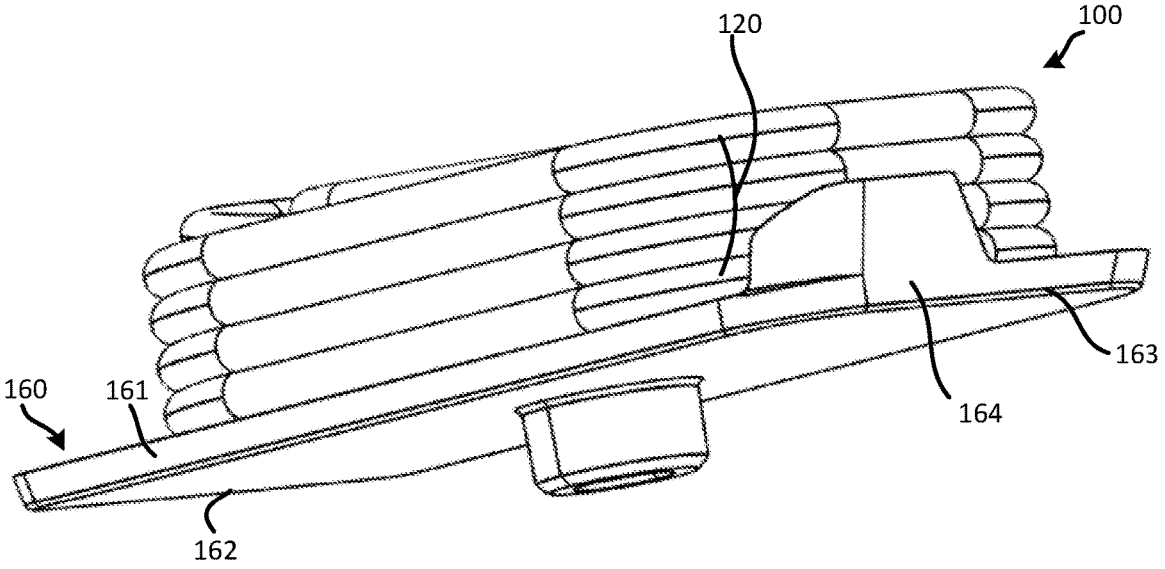
FIG. 3A illustrates a bottom, front, and side perspective view of a spring and spring plate, in accordance with an embodiment of the present disclosure.
Figure 3B:
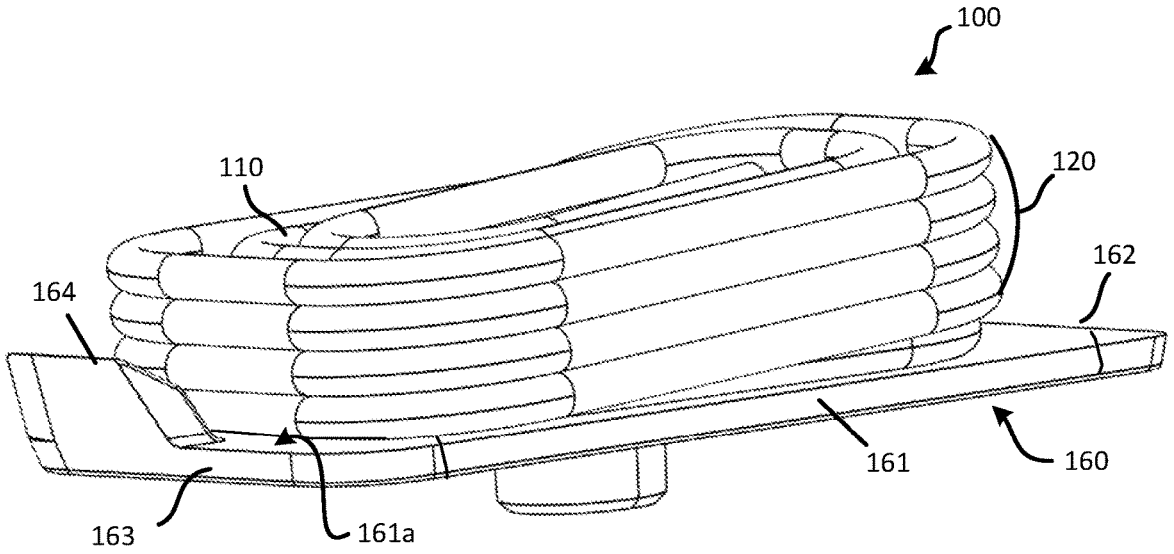
FIG. 3B illustrates a side and front perspective view of a spring and spring plate, in accordance with an embodiment of the present disclosure.
Figure 3C:
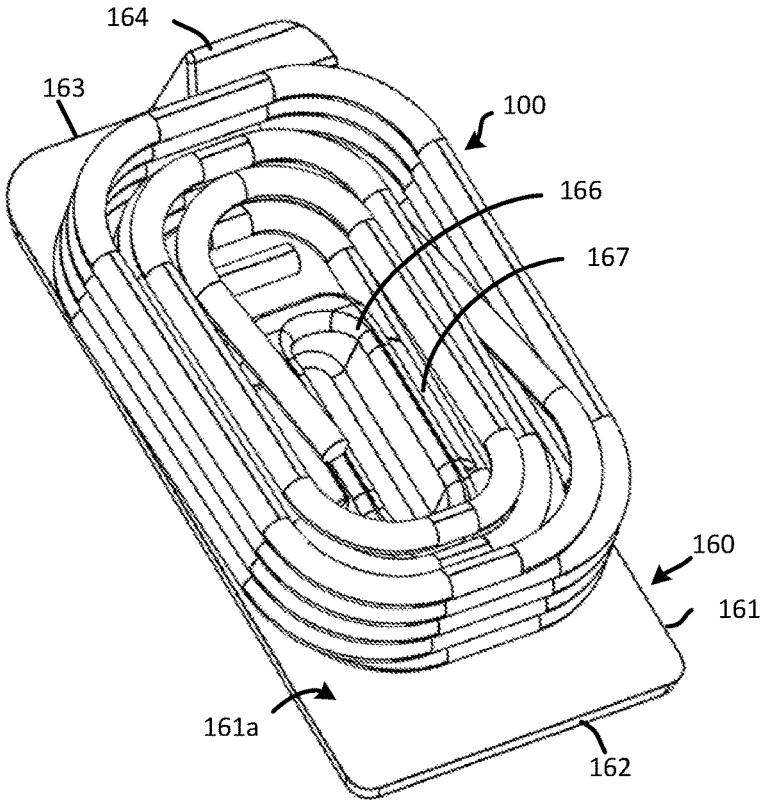
FIG. 3C illustrates a top perspective view of the spring and spring plate of FIG. 3A.
Figure 3D:
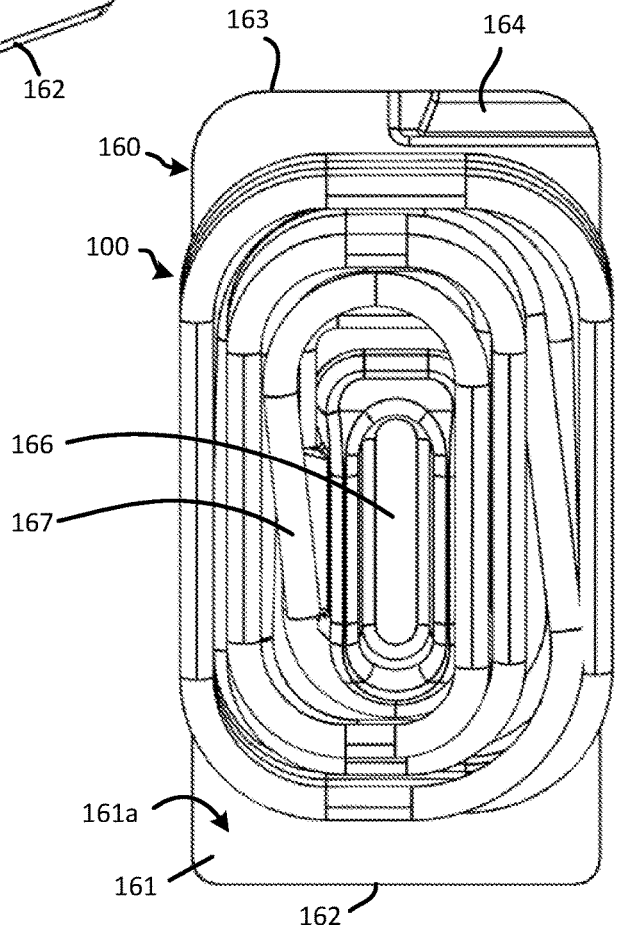
FIG. 3D illustrates a top plan view of the spring and spring plate of FIG. 3A.

FIGS. 3A-3D illustrate various views of spring 100 in a compressed or partially compressed state on a spring plate 160, in accordance with an embodiment of the present disclosure. FIG. 3A is a bottom, side, and front perspective view; FIG. 3B is a front and side perspective view; FIG. 3C is a top perspective view; and FIG. 3D is a top view. The spring 100 is on the top surface 161*a* of the spring plate 160 between the rear end 162 and a retaining tab 164 on the front end 163. The spring's bottom end portion 140 is around a top protrusion 166 extending up from the top surface of a plate body 161 of generally planar geometry. The top protrusion 166 includes catches 167 configured to overlap or capture straight segments 142*a*, 142*b* of the bottom end portion 140. Here, the upper coils 110 are not completely nested within the intermediate coils 120.

Figure 4A:
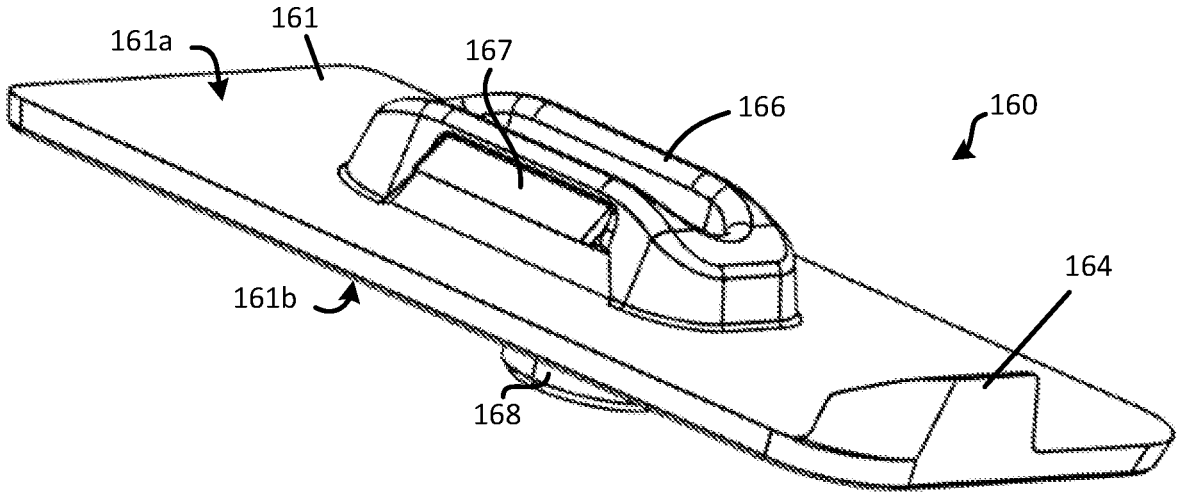
FIG. 4A illustrates a top, front, and side perspective view of a spring plate for a handgun magazine, in accordance with an embodiment of the present disclosure.
Figure 4B:
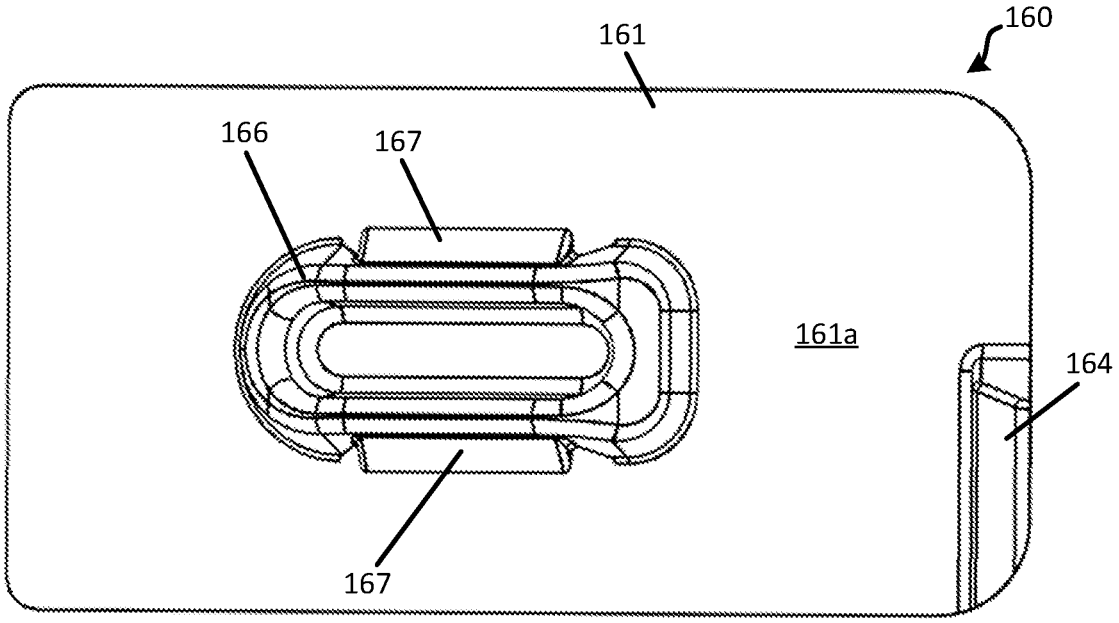
FIG. 4B illustrates a top plan view of the spring plate of FIG. 4A.

FIG. 4A illustrates a top and front perspective view of spring plate 160, and FIG. 4B illustrates a top plan view of spring plate 160, in accordance with an embodiment of the present disclosure. As mentioned above, spring plate 160 includes a plate body 161 of generally planar geometry and having a top protrusion 166 extending from its top surface 161*a*. The top protrusion 166 generally has an oval shape consistent with that of the bottom end portion 140 of the spring 100. Other geometries are acceptable. The top protrusion 166 includes catches 167 on its sides that are configured to overlap wire of the bottom end portion 140 so that the bottom end portion 140 is between the catch 167 and the plate body 161. The retaining tab 164 extends upward from a forward and right corner region of the plate body 161. In this position, the retaining tab 164 is out of the way of the follower when the magazine is filled to capacity, as will be discussed in more detail below. A bottom protrusion 168 extends from the bottom surface 161*b* of the plate body 161 and has a generally cylindrical geometry. The bottom protrusion 168 is useful to engage a corresponding recess in the magazine base plate to maintain the position of the spring plate 160 on the base plate. As such, the bottom protrusion 168 also functions as a retaining device in conjunction with retaining tab 164 to maintain the magazine in an assembled condition.

Figure 5A:
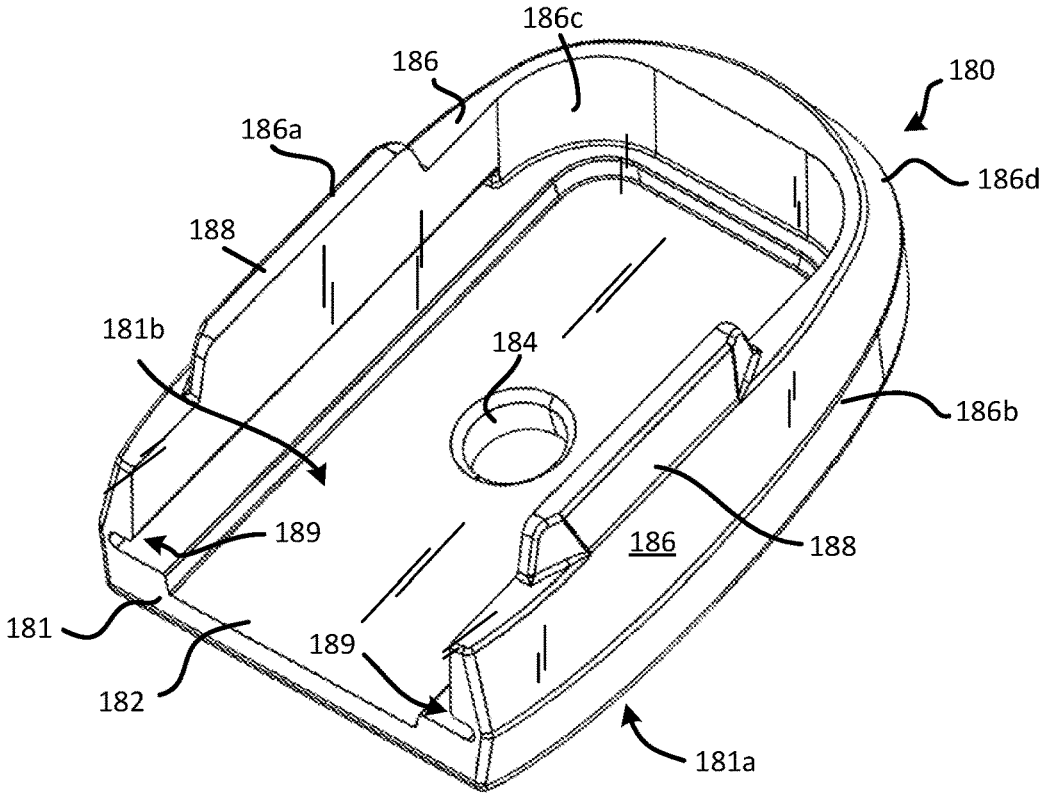
FIG. 5A illustrates a top, side, and rear perspective view of a base plate for a handgun magazine, in accordance with an embodiment of the present disclosure.
Figure 5B:
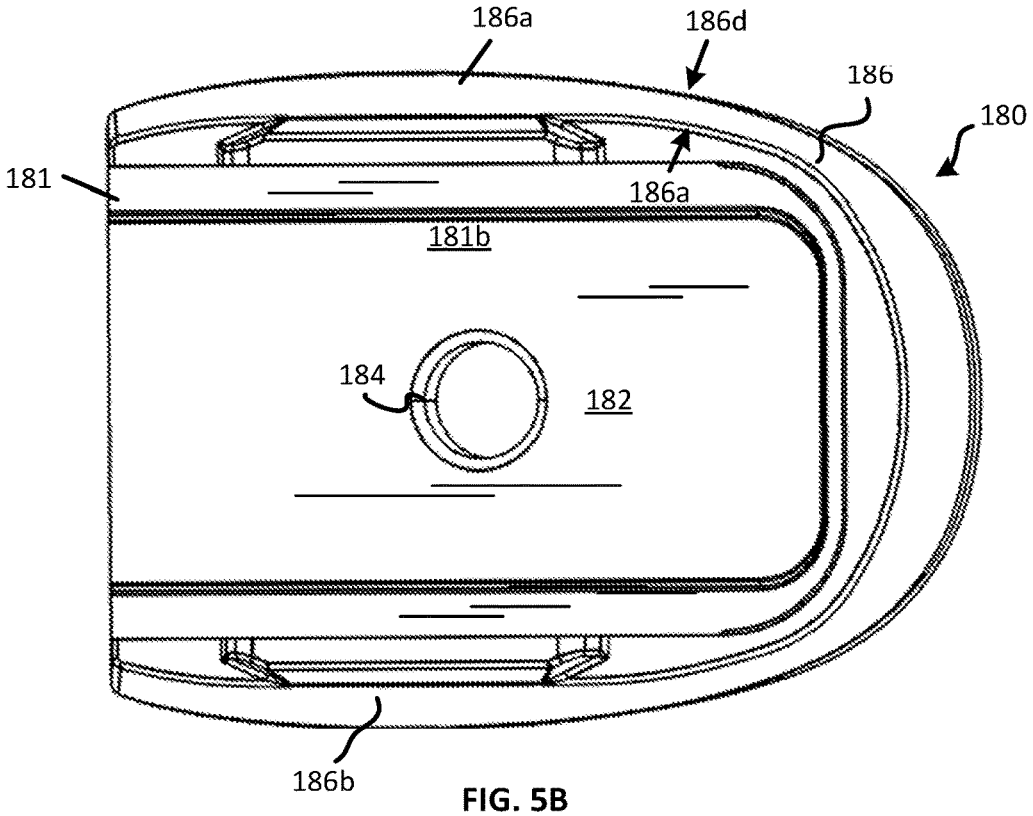
FIG. 5B illustrates a top plan view of the base plate of FIG. 5A.

FIG. 5A shows a top, side, and rear perspective view, and FIG. 5B shows a top plan view, of a base plate 180, in accordance with an embodiment of the present disclosure. The base plate 180 has a base plate body 181 with a planar bottom surface 181*a* and a top surface 181*b*. The top surface 181*b* defines a recess 182 shaped and sized to receive a spring plate 160, such as spring plate 160 shown in FIGS. 4A-4B, so that the top surface 161*a* of the spring plate 160 is substantially flush with or below the top surface 181*b* of the base plate body 181. Within the area of the recess 182, the base plate body 181 defines an opening 184 that extends through the base plate body 181, the opening 184 sized and shaped to receive the bottom protrusion 168 of the spring plate 160.

A wall 186 protrudes up above the top surface 180*b* and extends along the sides and front of the base plate body 181. The wall 186 has a contour that is configured to mate with the outside surface of the magazine tube when assembled. Typically, the inside surface 186*c* of the wall 186 contacts the magazine tube when assembled therewith, however, a gap between the tube and the inside surface 186*c* is permissible, although not preferred. The outside surface 186*d* of the wall 186 can be continuous with the outside surface of the base plate body 181, but it does not necessarily have to be. In an assembled state, the bottom of the magazine tube is received within the bounds of the wall 186 and in contact with the top surface 181*b* of the base plate body 181. In this example, lateral portions 186*a*, 186*b* of the wall 186 each includes a vertical protrusion 188.

The wall 186 defines an undercut 189 along each lateral portion 186*a*, 186*b*, positioned between the top surface 181*b* of the base plate body 181 and the wall 186, and extending forward from a rear end 180*a* of the base plate 180. The undercut 189 is open at the rear end 180*a* to enable laterally-extending lips or flange at the bottom of the magazine tube to be slidably received in the undercut 189 as the base plate 180 is slid onto the end of the magazine tube.

Figure 6A:
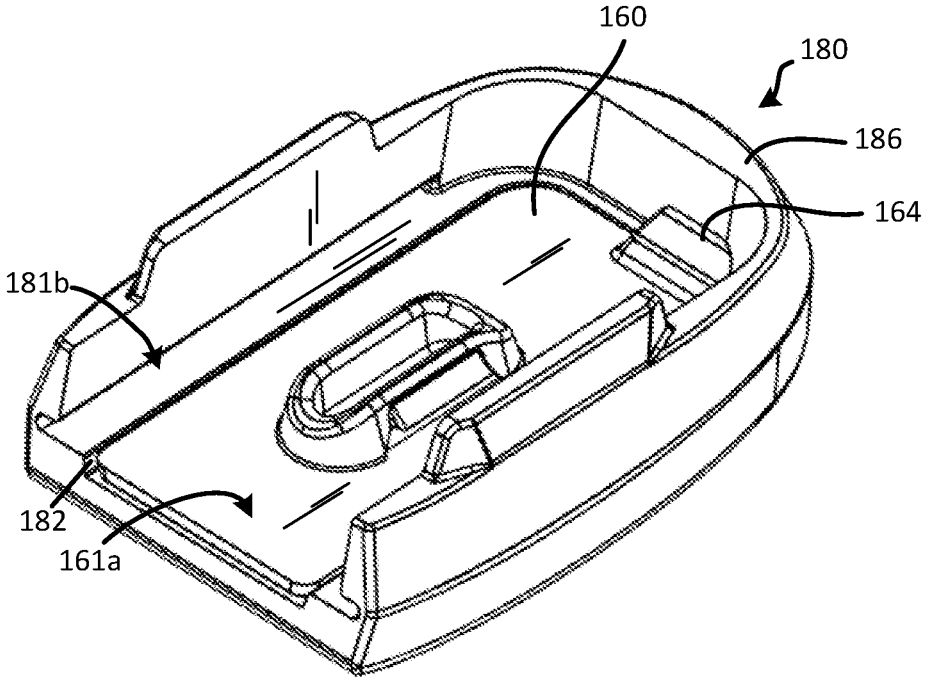
FIG. 6A illustrates a top, side, and rear perspective view of a base plate and spring plate for a handgun magazine, in accordance with an embodiment of the present disclosure.

FIG. 6A illustrates a top, side, and rear perspective view of the magazine base plate 180 together with spring plate 160 received in the recess 182. Note that the retaining tab 164 is spaced from the wall 186 such that a sidewall of the magazine tube can be received in the gap. Note also that the top surface 161*a* of the spring plate 160 is substantially flush with the top surface 181*b* of the base plate body 181.

Figure 6B:
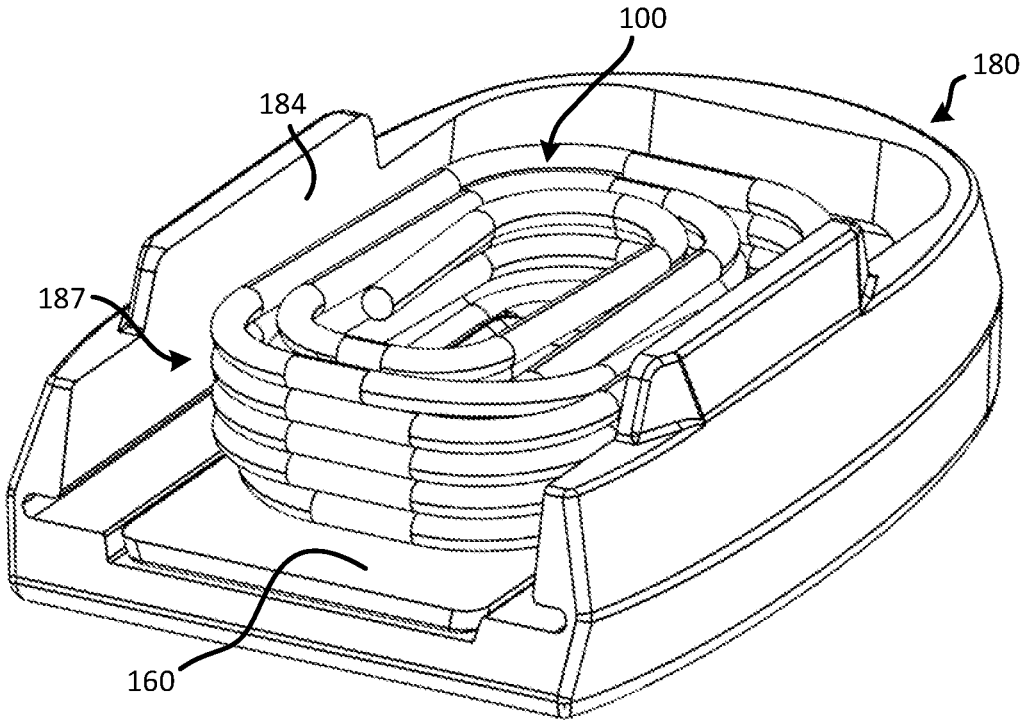
FIG. 6B illustrates a rear and side perspective view of a base plate, spring plate, and spring in a compressed condition, in accordance with an embodiment of the present disclosure.

FIG. 6B illustrates a rear perspective view of the base plate 180, spring plate 160, and spring 100, where the spring 100 is in a compressed state, in accordance with an embodiment. Note in this example that a gap 187 exists between the wall 186 and the spring 100 to receive the magazine tube.

Figure 7A:
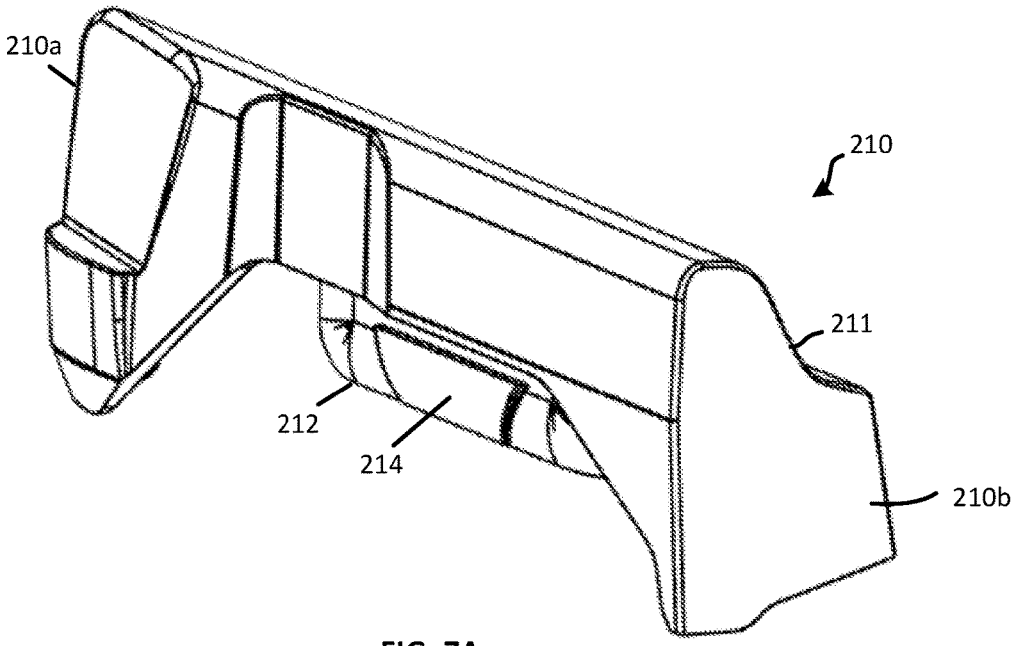
FIG. 7A illustrates a side and rear perspective view of a follower for a handgun magazine, in accordance with an embodiment of the present disclosure.
Figure 7B:
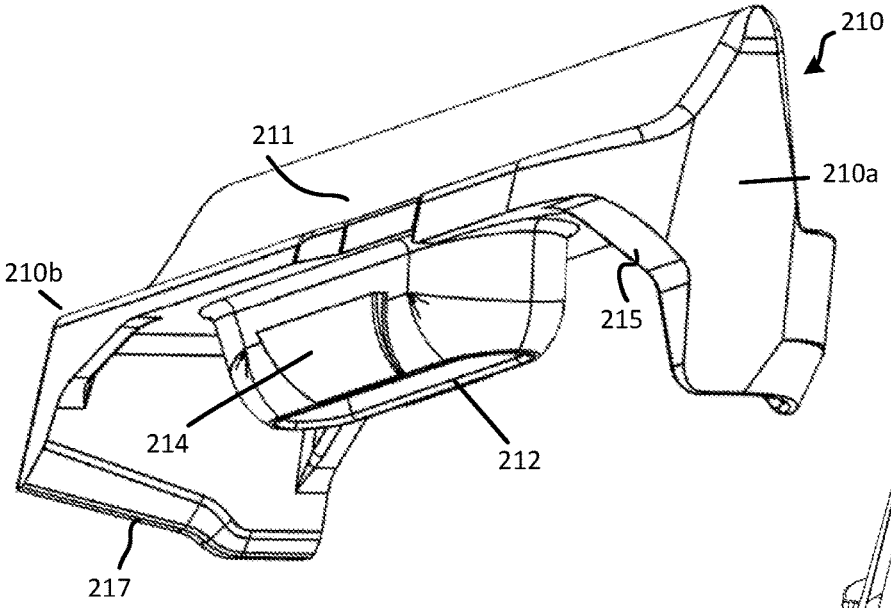
FIG. 7B illustrates a bottom, front, and side view of the follower of FIG. 7A.
Figure 7C:
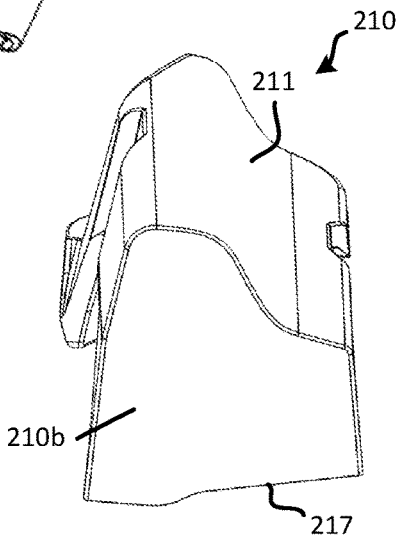
FIG. 7C illustrates a rear view of the follower of FIG. 7A.

FIGS. 7A-7C show various views of a follower 210, in accordance with an embodiment of the present disclosure. FIG. 7A is a top, side, and rear perspective view; FIG. 7B is a bottom, front, and side perspective view; and FIG. 7C is a rear view. The follower 210 has an arcuate top surface 210*a* that extends between a front end 210*a* and a rear end 210*b*. Sides of the follower 210 are cut away below the top surface 211 to accommodate coils of the spring 100 when the spring 100 is in a compressed condition, for example. A spring protrusion 212 extends downward from an underside of the follower and generally has an oval shape to engage the top end portion 102 of the spring 100. In some embodiments, the spring protrusion 212 includes catches 214 that extend outward from sides of the spring protrusion 212. The catches 214 aid in retaining the top end portion 102 of the spring 100 on the spring protrusion 212. As best shown in FIG. 7A, part of the front wall defines a cut away 215 to provide clearance for the retaining tab 164 on the spring plate 160. The cut away 215 is located on one side of the follower 210 in this example, but can have other positions, such as being near the center of the front wall of the follower 210, in some embodiments. As best shown in FIG. 7C, the rear wall has a lower margin 217 that inclines from one side to another (e.g., left to right as viewed from behind). In use, the incline of the lower margin 217 facilitates the rear end 210*b* driving into the space between the spring 100 and the magazine tube 220 when loading the last one or two rounds of a full magazine; the inclined profile functions as a wedge to make it easer to force the rear end 210*b* into that space and therefore can make it easier to load the final round.

Figure 8:
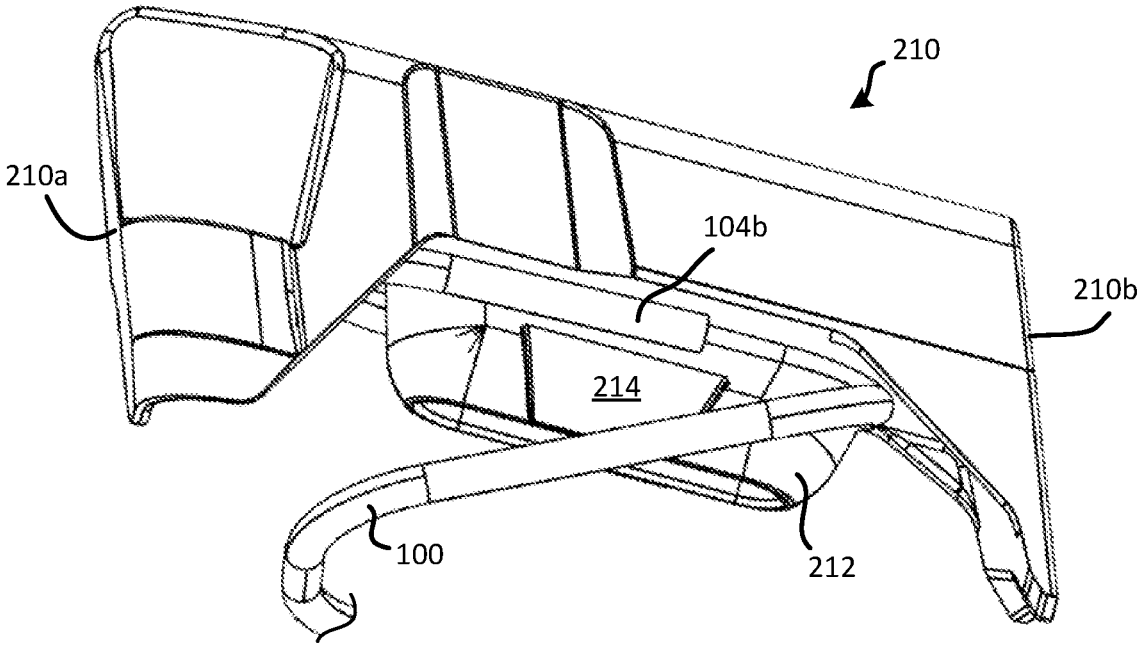
FIG. 8 illustrates a bottom and side perspective view showing a top end portion of a spring engaging the spring protrusion of a follower, in accordance with an embodiment of the present disclosure.
Figure 14:
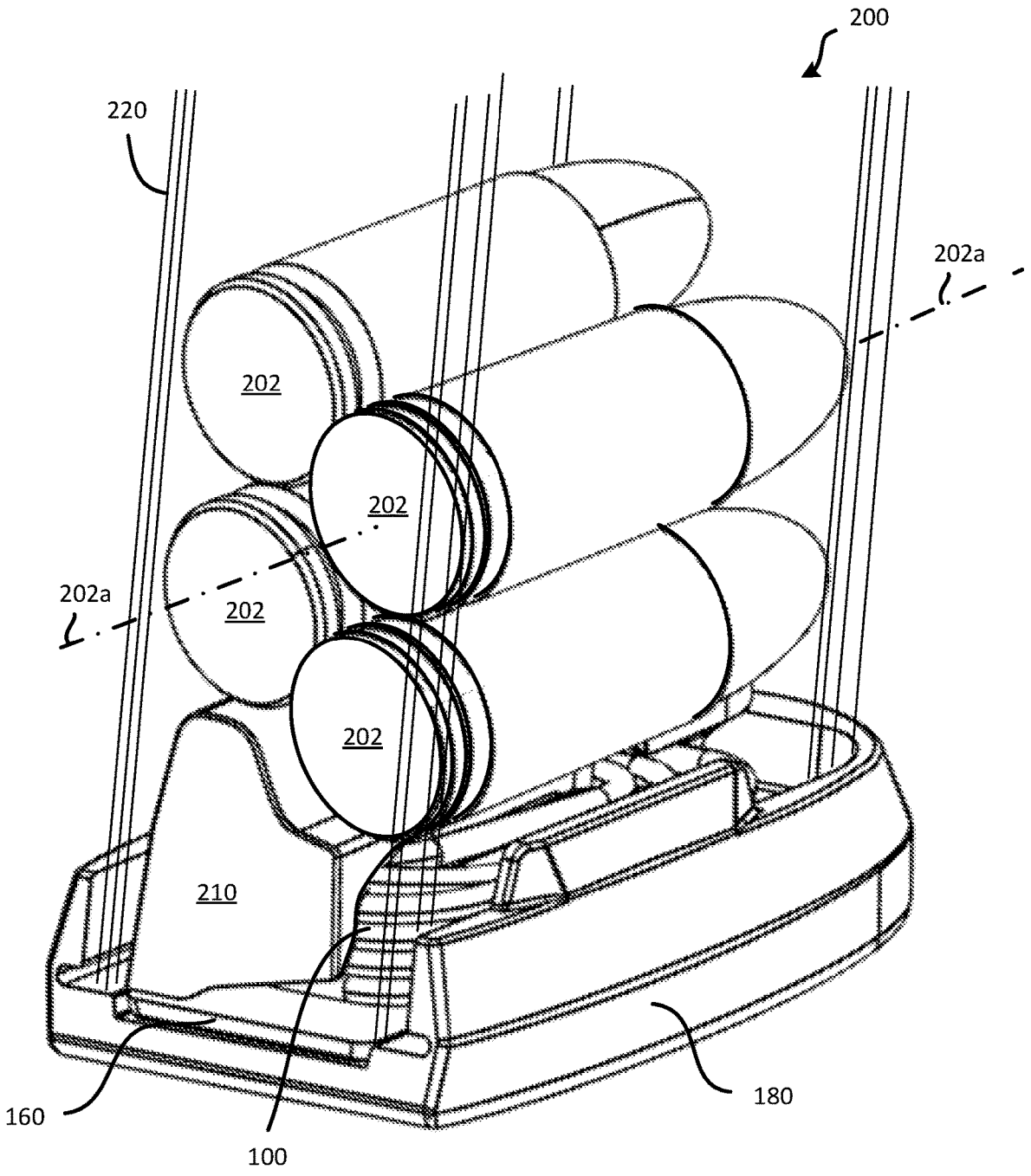
FIG. 14 illustrates a rear perspective view showing components in the lower portion of a magazine assembly when the magazine is loaded to capacity, in accordance with an embodiment of the present disclosure.

FIG. 8 illustrates a side view showing the left and bottom sides of a follower 210 and part of a spring 100 engaging the spring protrusion 212 of the follower 210, in accordance with an embodiment of the present disclosure. The top end portion 102 is around the spring protrusion 212. Catches 214 on opposite sides of the spring protrusion 212 help to capture straight segments 104*a*, 104*b* of the top end portion 102 to retain the follower 210 engaged with the top end portion 102. The underside of the follower 210 is open and sides of the follower 210 beneath the top surface are cut away to receive part of the spring 100 when the spring 100 is in a compressed condition. For example, the front end 210*a* and rear end 210*b* of the follower 210 overlap the coil stack of the spring 100 when the spring 100 is fully compressed or near-fully compressed, such as shown in FIG. 14.

Figure 9:
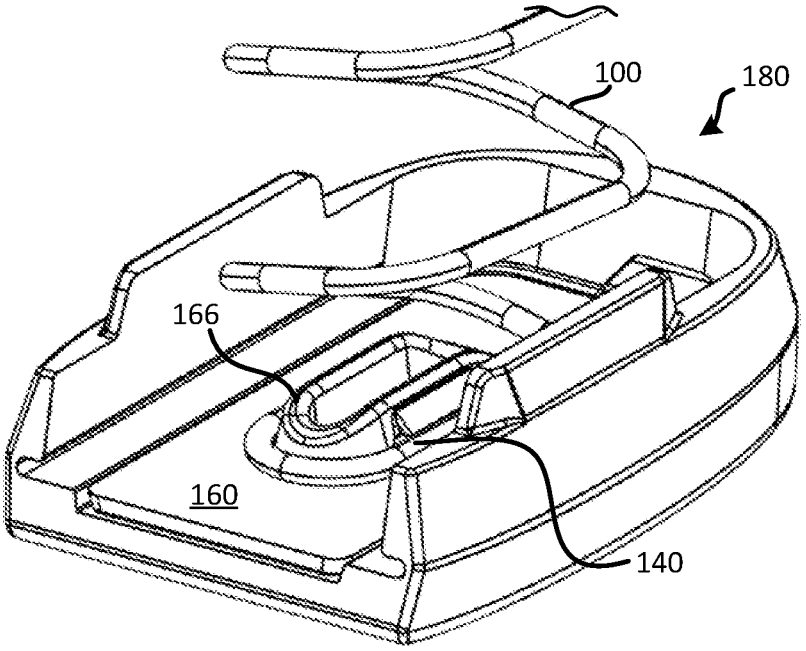
FIG. 9 illustrates a top, side, and rear perspective view showing a lower portion of a magazine spring having a bottom end portion around a protrusion on a spring plate, and the spring plate recessed into a base plate, in accordance with an embodiment of the present disclosure.

FIG. 9 illustrates a perspective view showing top, rear, and right side of the base plate 180, spring plate 160, and lower part of the spring 100. The spring 100 is on the spring plate 160 with the bottom end portion 140 around the top protrusion 166.

Figure 10:
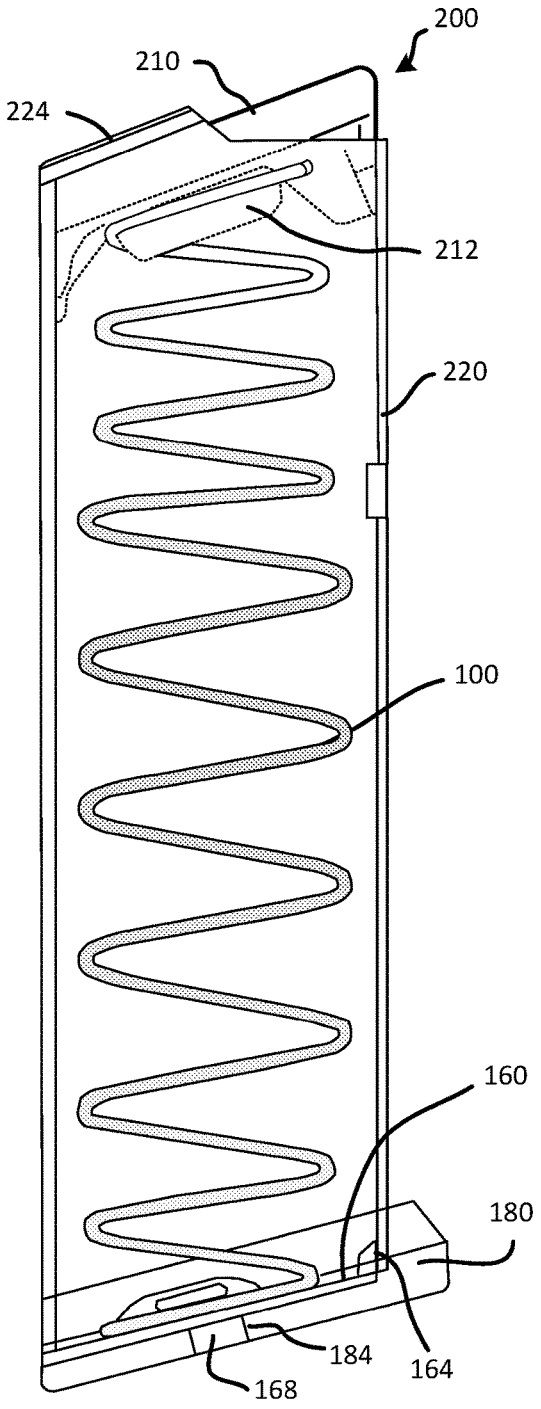
FIG. 10 illustrates a side view of a handgun magazine assembly, in accordance with an embodiment of the present disclosure.

FIG. 10 illustrates a side view of a magazine 200 in an assembled and empty condition, in accordance with an embodiment of the present disclosure. The magazine 200 is configured for a handgun and includes a magazine tube 220 (shown as transparent), follower 210, spring 100, base plate 180, and spring plate 160. In its empty condition, the spring 100 is slightly compressed so as to urge the follower 210 toward the feed lips 224 the open top end of the magazine 200. The spring 100 also exerts a force on the spring plate 160 toward the base plate 180. The spring 100 is retained in various amounts of compression between the spring plate 160 and the follower 210 while the magazine 200 is empty, and spring 100 becomes more and more compressed as ammunition 202 is installed and follower 210 moves down the tube 220. At the bottom of the magazine tube 220, a tube flange 222 flares laterally outward from each side and is received in the undercut 189 on each side of the base plate 180. The spring plate 160 is recessed into the base plate 180 with the bottom protrusion 168 extending into the opening 184. The retaining tab 164 on the spring plate 160 extends into the magazine tube 220 and blocks the base plate 180 from sliding off the tube 220. When the user pushes the spring plate 160 into the tube 220 so that the bottom protrusion 168 disengages from the base plate 180, the base plate 180 can be removed from the bottom of the tube 220.

Figure 11:
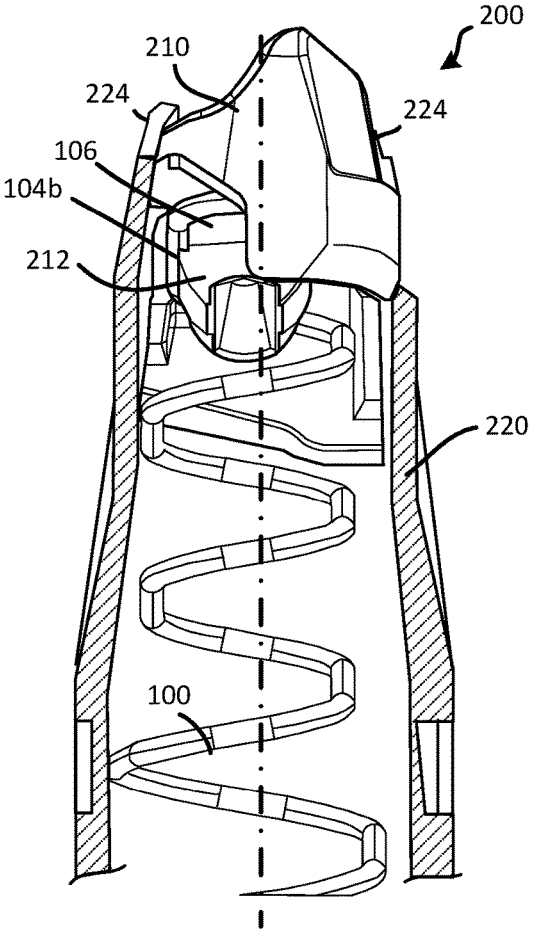
FIG. 11 illustrates a front and partial cross-sectional view of an upper portion of a handgun magazine, in accordance with an embodiment of the present disclosure.

FIG. 11 illustrates a front and partial cross-sectional view of an upper portion of the magazine 200 of FIG. 10, where the magazine tube is shown as a cross section. The top end portion 102 wraps around the spring protrusion 212. A central magazine axis 201 extends vertically through the magazine 200. Note that the spring protrusion 212 is slightly laterally offset from the central magazine axis 201, which facilitates vertical stacking of the spring 100 coils without crumpling of the spring 100. Part of one front corner of the follower 210 is cut away for clearance with intermediate coils of the spring 100 and with retaining tab 164 on the spring plate 160 when the magazine 200 is filled to capacity (or slightly beyond) and the front of the follower 210 makes contact or is close to making contact with the spring plate 160.

Figure 12:
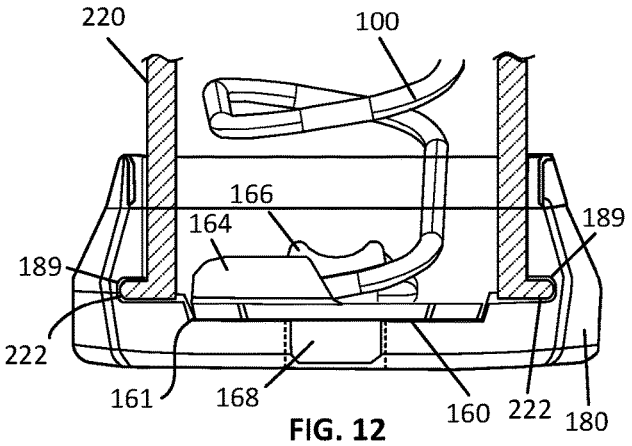
FIG. 12 illustrates a front view of a lower portion of a handgun magazine assembly, in accordance with an embodiment of the present disclosure.

FIG. 12 shows a front view of a lower portion of a magazine 200, in accordance with an embodiment of the present disclosure. In this example, the tube flange 222 of the magazine tube 220 (shown in cross-section) can be seen occupying the undercuts 189 on each side of the base plate 180 (shown as transparent). The plate body 161 is recessed into the base plate 180 with the spring 100 extending around the top protrusion 166. In the locked condition as shown, one or more obstructions exist between the bottom protrusion 168, the plate body 161, the base plate 180, and the retaining tab 164 that prevent removal of the base plate 180 from the magazine tube 220. Pushing the spring plate 160 up into the magazine tube 220 would eliminate the obstruction and allow the base plate 180 to slide forward off the bottom of the tube 220 along tube flange 222.

Figure 13:
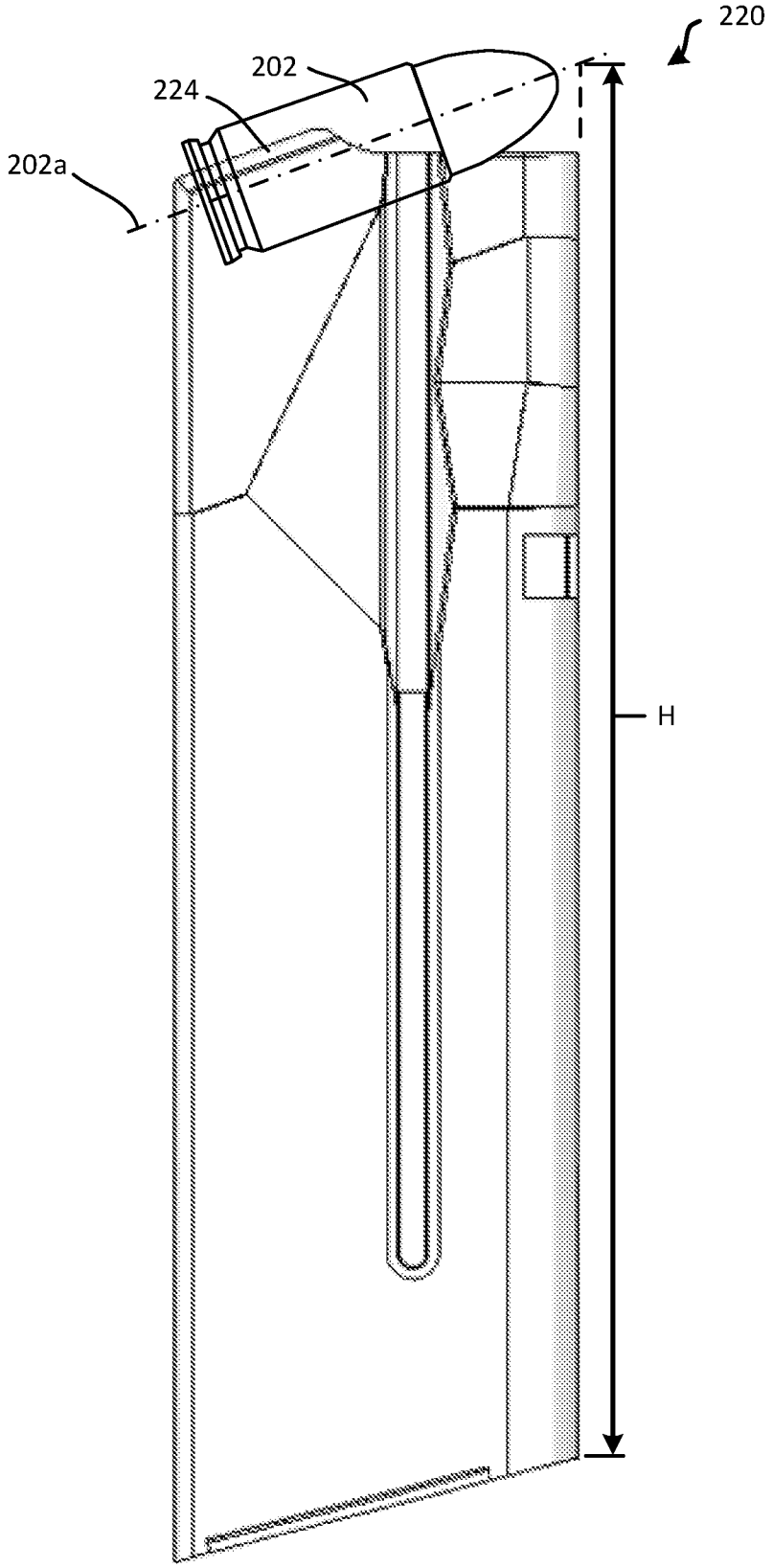
FIG. 13 illustrates a side view of a magazine tube and ammunition cartridge, in accordance with an embodiment of the present disclosure.

FIG. 13 illustrates a side view of a magazine tube 220 with an ammunition cartridge 202 retained by the feed lips 224, in accordance with an embodiment of the present disclosure. The magazine tube 220 has a height H measured along the front wall of the tube 220 from a front bottom margin to an imaginary intersection with the ammunition's central axis 202*a*. In one embodiment, height H is not greater than 120 mm, including not greater than 117 mm, not greater than 115 mm, not greater than 114 mm, not greater than 112 mm, in a range from 110 to 114 mm, in a range from 110 to 116 mm, in a range from 110 to 119 mm, in a range from 110 to 114 mm, in a range from 110 to 112 mm, in a range from 114 to 118 mm, in a range from 114 to 116 mm, in a range from 112 to 118 mm, and in a range from 112 to 120 mm. In some embodiments, the height H is from 110-120 mm. In another embodiment, height H is not greater than 122 mm, including not greater than 119 mm, not greater than 117 mm, not greater than 116 mm, not greater than 114 mm, or not greater than 112 mm; in a range from 110 to 122 mm, in a range from 110 to 118 mm, in a range from 114 to 120 mm, in a range from 112 to 122 mm, in a range from 114 to 118 mm, in a range from 114 to 117 mm, and other ranges between values from 110 to 122 mm. In some embodiments, the height H is from 114-120 mm. In some such embodiments, the magazine 200 has a capacity of 17 rounds of 9×19 mm ammunition (aka 9 mm Luger) when the magazine 200 includes the follower 210, base plate 180, spring plate 160, and spring 100 as discussed above and shown, for example, in FIG. 10. Further, in some such embodiments, the spring 100 has no more than 11 coils, including 9-11 coils, 10 coils, and 9 coils.

FIG. 14 illustrates a rear perspective view of a lower portion of a magazine 200 loaded to capacity with ammunition 202, in accordance with an embodiment of the present disclosure. The magazine 200 includes a base plate 180, spring plate 160, spring 100, follower 210, and magazine tube 220. In this example, the magazine tube 220 is illustrated as being transparent to better show the components within the magazine tube 220. Also, while only four rounds of ammunition 202 are shown, the position of the spring 100 and follower 210 are representative of the magazine 200 being loaded to capacity (e.g., 17 rounds) and the spring 100 is fully compressed or near-fully compressed.

Ammunition 202 on top of the follower in an offset, double-stack arrangement. The follower 210 overlaps the spring 100 at the front and back, and the follower 210 is cut away on its sides to accommodate the coils of the spring 100. The spring protrusion 212 on the underside of the follower 210 extends into the nested coils of the spring 100. Note that a central axis 202*a* of the ammunition 202 is inclined downward with respect to the bottom surface 181*a* of the base plate 180.

Figure 15A:
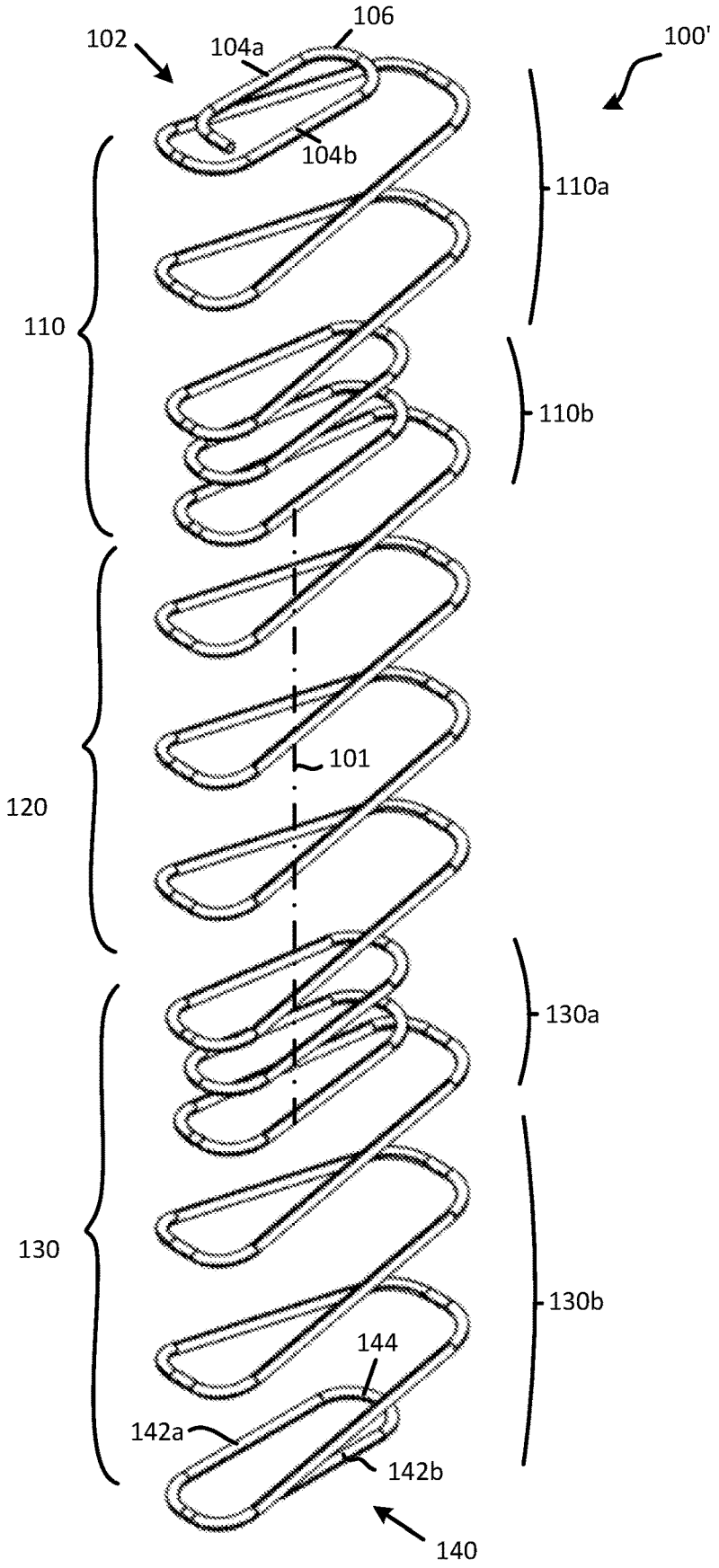
FIG. 15A illustrates a perspective view of a magazine spring for a rifle magazine in an uncompressed state, in accordance with another embodiment.
Figure 15B:
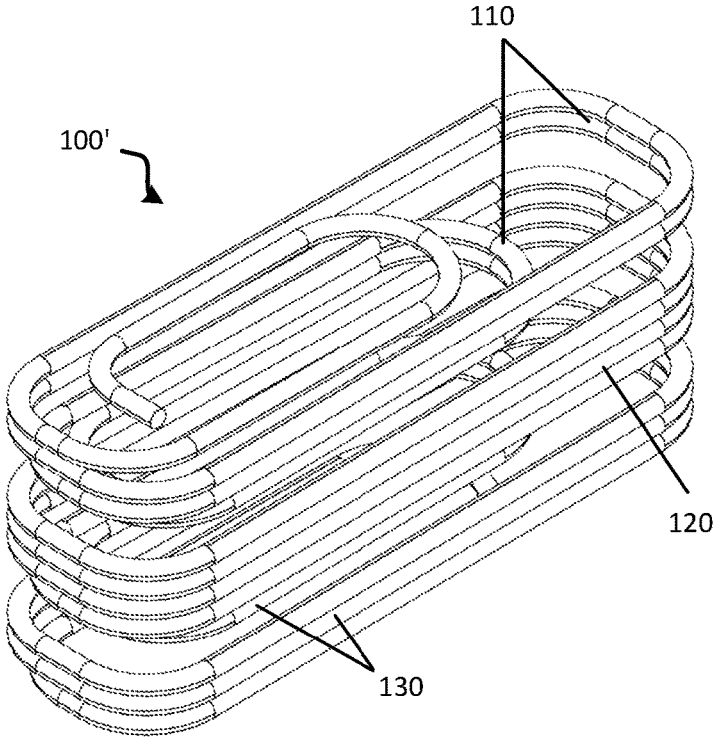
FIG. 15B illustrates an isometric view of the magazine spring of FIG. 15A in a mostly compressed state, in accordance with an embodiment.
Figure 15C:
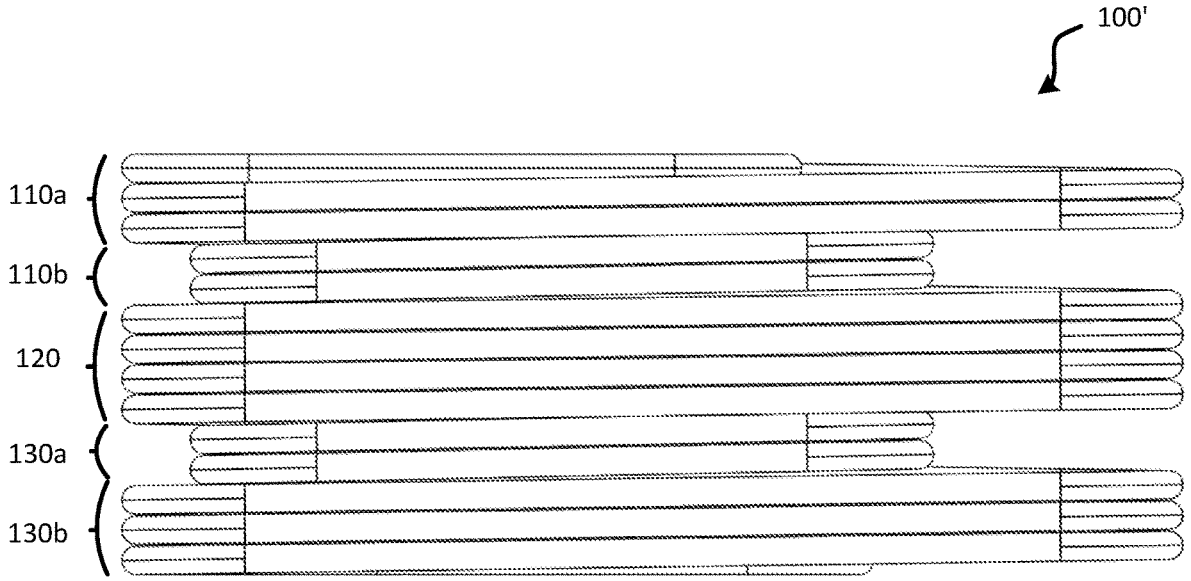
FIG. 15C illustrates a side view of the magazine spring of FIG. 15B.

FIGS. 15A-15C illustrate a magazine spring 100' configured for use in a magazine for rifle ammunition, in accordance with an embodiment of the present disclosure. FIG. 15A is a perspective view showing the spring 100' in a free state. FIG. 15B is an isometric view and FIG. 15C is a side view showing the spring 100' in a mostly compressed state. The spring 100' extends along a central spring axis 101 from a bottom end portion 140 to a top end portion 102 and includes alternating sections of coils of a smaller size and soils of a larger size. The larger coils 110*a*, 120, 130*b* of spring 100' have a rectangular shape while the smaller coils 110*b*, 130*a* have a racetrack shape. When compressed fully to solid height, all or most of the smaller coils can nest within the coils of the larger size so that the coils of larger size stack upon each other.

The top end portion 102 that includes straight segments 104*a*, 104*b* and turn 106. Straight segment 104*b* is part of one of the upper spring coils 110 which include larger upper coils 110*a* of a larger size and smaller upper coils 110*b* of a smaller size. Intermediate spring coils 120 of the larger size are below the smaller upper coils 110*b* and connect to lower spring coils 130, which include larger lower coils 130*b* of the larger size and smaller lower coils 130*a* of the smaller size. The larger lower coils 130*b* connect to straight segments 142*a*, 142*b* that are part of the lower-most coil.

Some or all of the upper spring coils 110 can nest within the intermediate spring coils 120 when the spring 100 is compressed. In some embodiments, at least two complete coils of the upper spring coils 110 nest (or can nest) within the intermediate spring coils 120. In some embodiments, at least three complete upper spring coils 110 can nest within the intermediate coils 120. Similarly, some or all of the lower spring coils 130 can nest within the intermediate spring coils 120 when the spring 100 is compressed. In some embodiments, at least two complete coils of the lower spring coils 130 nest (or can nest) within intermediate coils 120. In some embodiments, at least three coils of the lower spring coils 130 can nest within intermediate coils 120.

In the side view of FIG. 15C, the spring 100' is shown in a mostly compressed state. Here, only two coils of the smaller upper coils 110*b* and smaller lower coils 130*a* are visible due to partial nesting of smaller coils. Upon further compression to the solid height, the smaller upper coils 110*b* and smaller lower coils 130*a* nest completely within the adjacent larger coils so that larger upper coils 110*a*, intermediate coils 120 and larger lower coils 130*b* stack vertically on top of each other.

Further Example Embodiments

The following examples pertain to further embodiments, from which numerous permutations and configurations will be apparent.

Example 1 is a spring for a firearm magazine, the spring comprising a top attachment leg; a plurality of upper coils below the top attachment leg; a plurality of intermediate coils below the upper coils; and a bottom attachment leg below the plurality of intermediate coils, wherein individual coils of the plurality of intermediate coils have a rectangular coil shape, and wherein the upper coils are sized and shaped to nest within the plurality of intermediate coils when the spring is fully compressed.

Example 2 includes the subject matter of Example 1, wherein the upper coils have an oval coil shape.

Example 3 includes the subject matter of Example 1, wherein the upper coils have a rectangular coil shape.

Example 4 includes the subject matter of any one of Examples 1-3, further comprising a plurality of lower coils between the plurality of intermediate coils and the bottom attachment leg.

Example 5 includes the subject matter of Example 4, wherein the lower coils have a rectangular coil shape.

Example 6 includes the subject matter of Example 4, wherein the upper coils and/or the lower coils have an oval shape.

Example 7 includes the subject matter of any one of Examples 4-6, wherein the lower coils are sized and shaped to nest at least partially within the plurality of intermediate coils when the spring is fully compressed.

Example 8 includes the subject matter of Example 7, wherein when the spring is fully compressed, the top attachment leg is sized and shaped to nest within the plurality of upper coils, and the bottom attachment leg is sized and shaped to nest within the plurality of lower coils.

Example 9 includes the subject matter of any one of Examples 1-8, wherein the spring has from 9 to 11 coils.

Example 10 includes the subject matter of any one of Examples 1-9, wherein the spring has a maximum solid height of not more than 6 wire diameters.

Example 11 includes the subject matter of any one of Examples 1-10, wherein a front portion of the spring has a solid height of not more than 4 wire diameters.

Example 12 includes the subject matter of any one of Examples 1-11, wherein the wire diameter is from 1.1 to 1.45 mm, preferably 1.2-1.3 mm.

Example 14 includes the subject matter of any one of Examples 1-12, wherein the spring is configured for the firearm magazine sized for handgun ammunition.

Example 15 includes the subject matter of any one of Examples 1-12, wherein the spring is configured for the firearm magazine sized for rifle ammunition.

Example 16 is a magazine parts kit comprising the spring of any one of Examples 1-12, a magazine base plate, a follower, and a spring plate configured to nest with the magazine base plate.

Example 17 includes the subject matter of Example 15, wherein the base plate has a base plate body with a top surface that defines a recess sized and shaped to receive the spring plate such that the spring plate is recessed into the base plate body.

Example 18 includes the subject matter of any one of Examples 16 or 17, wherein the follower is configured such that a front portion and a rear portion of the follower overlap the intermediate coils when the spring is fully compressed.

Example 19 includes the subject matter of any one of Examples 16-18, wherein one or both sides of the follower are cut away to accommodate the intermediate coils when the spring is fully compressed.

Example 20 includes the subject matter of any one of Examples 16-19, wherein a lower rear margin of the follower is inclined with respect to a horizontal.

Example 21 includes the subject matter of any one of Examples 16-20, wherein an underside of the follower defines a protrusion configured to engage the top end portion of the spring, wherein the protrusion is laterally offset from a center of the follower.

Example 22 is a handgun magazine comprising a magazine tube extending along a central axis from a bottom end to a top end having feed lips; a follower retained in the magazine tube; a base plate on the bottom end of the magazine tube; a spring plate with a plate body; and a spring retained within the magazine tube between the spring plate and the follower, the spring including a top attachment leg, a bottom attachment leg, a plurality of upper coils, and a plurality of intermediate coils below the plurality of upper coils, wherein when the spring is compressed, at least two of the plurality of upper coils nest within the plurality of intermediate coils. In other examples, at least three of the upper coils nest within the intermediate coils.

Example 23 includes the subject matter of Example 22, wherein individual coils of the plurality of intermediate coils have a rectangular coil shape.

Example 24 includes the subject matter of any one of Examples 22-23, where the base plate has a base plate body with a top surface that defines a recess sized and shaped to receive the plate body of the spring plate such that the plate body is recessed into the base plate body.

Example 25 includes the subject matter of any one of Examples 22-24, wherein a rear end of the spring plate is between the magazine tube and the base plate.

Example 26 includes the subject matter of any one of Examples 22-25, wherein a height of the magazine tube, measured along a front wall of the magazine tube from a front bottom margin to an imaginary line through a central axis of a cartridge retained by the feed lips, is not greater than 120 mm.

Example 27 includes the subject matter of Example 26, wherein the height is not greater than 118 mm.

Example 28 includes the subject matter of any one of Examples 22-27, wherein an underside of the follower defines a protrusion configured to engage the top attachment leg of the spring, wherein the protrusion is laterally offset from a center of the follower.

Example 29 includes the subject matter of any one of Examples 22-28, wherein the follower is configured such that a front end portion and a rear end portion of the follower overlap at least some of the plurality of intermediate coils when the spring is fully compressed.

Example 30 includes the subject matter of Example 29, wherein sides of the follower are cut away to accommodate the plurality of intermediate coils when the spring is fully compressed.

Example 31 includes the subject matter of any one of Examples 22-30, wherein a lower rear margin of the follower is inclined with respect to a horizontal.

Example 32 includes the subject matter of any one of Examples 22-31, wherein the magazine has a capacity of 17 cartridges of 9 mm Luger ammunition.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A spring for a firearm magazine, comprising:
- a top attachment leg;
- a plurality of upper coils connected to the top attachment leg;
- a plurality of intermediate coils below the upper coils;
- a bottom attachment leg below the plurality of intermediate coils; and
- a plurality of lower coils between the plurality of intermediate coils and the bottom attachment leg;
- wherein individual coils of the plurality of intermediate coils have a rectangular coil shape; and
- wherein at least two of the plurality of upper coils nest within the plurality of intermediate coils when the spring is fully compressed; and
- wherein the top attachment leg nests within the plurality of upper coils and the bottom attachment leg nests within the plurality of lower coils when the spring is fully compressed.

2. The spring of claim 1, wherein the upper coils have an oval coil shape.

3. The spring of claim 1, wherein the upper coils have a rectangular coil shape.

4. The spring of claim 1, wherein the lower coils have a rectangular coil shape.

5. The spring of claim 1, wherein the plurality of upper coils and/or the plurality of lower coils have an oval shape.

6. The spring of claim 1, wherein the lower coils are sized and shaped to nest at least partially within the plurality of intermediate coils when the spring is fully compressed.

7. The spring of claim 1, wherein the spring has from 9 to 11 coils.

8. The spring of claim 7, wherein the spring has a maximum solid height of not more than 6 wire diameters.

9. The spring of claim 8, wherein a front portion of the spring has a solid height of not more than 4 wire diameters.

10. The spring of claim 1, wherein the wire diameter is from 1.2 mm to 1.4 mm.

11. A magazine parts kit comprising:
- the spring of claim 1;
- a magazine base plate;
- a follower; and
- a spring plate configured to nest with the magazine base plate.

12. The magazine parts kit of claim 11, wherein the magazine base plate has a base plate body with a top surface that defines a recess sized and shaped to receive the spring plate such that the spring plate is recessed into the base plate body.

13. The magazine parts kit of claim 11, wherein the follower is configured such that a front portion and a rear portion of the follower overlap the intermediate coils when the spring is fully compressed.

14. The magazine parts kit of claim 13, wherein one or both sides of the follower are cut away to accommodate the intermediate coils when the spring is fully compressed.

15. The magazine parts kit of claim 14, wherein a lower rear margin of the follower is inclined with respect to a horizontal.

16. The magazine parts kit of claim 11, wherein an underside of the follower defines a protrusion configured to engage the top end portion of the spring, wherein the protrusion is laterally offset from a center of the follower.

17. A handgun magazine comprising:
- a magazine tube extending along a central axis from a bottom end to a top end having feed lips;
- a follower retained in the magazine tube;
- a base plate on the bottom end of the magazine tube;
- a spring plate with a plate body; and
- a spring retained within the magazine tube between the spring plate and the follower, the spring including a top attachment leg, a bottom attachment leg, a plurality of upper coils, a plurality of lower coils, and a plurality of intermediate coils below the plurality of upper coils,
- wherein, when the spring is fully compressed, at least two upper coils nest within the plurality of intermediate coils, the top attachment leg nests within the plurality of upper coils, and the bottom attachment nests within the plurality of lower coils.

18. The handgun magazine of claim 17, wherein individual coils of the plurality of intermediate coils have a rectangular coil shape.

19. The handgun magazine of claim 18, wherein at least some of the lower coils nest within the plurality of intermediate coils when the spring is fully compressed.

* * * * *